US012359353B2

(12) United States Patent
Andreoli et al.

(10) Patent No.: US 12,359,353 B2
(45) **Date of Patent: *Jul. 15, 2025**

(54) SUPPORT AND CONTROL DEVICE FOR CIRCULAR KNITTING MACHINES

(71) Applicant: SANTONI S.P.A., Brescia (IT)

(72) Inventors: Marco Andreoli, Castegnato (IT); Stefano Rizzi, Brescia (IT)

(73) Assignee: SANTONI S.P.A., Brescia (IT)

( * ) Notice: Subject to any disclaimer, the term of this patent is extended or adjusted under 35 U.S.C. 154(b) by 22 days.

This patent is subject to a terminal disclaimer.

(21) Appl. No.: 17/442,020

(22) PCT Filed: Apr. 9, 2020

(86) PCT No.: PCT/IB2020/053384

§ 371 (c)(1),
(2) Date: Sep. 22, 2021

(87) PCT Pub. No.: WO2020/208566

PCT Pub. Date: Oct. 15, 2020

(65) Prior Publication Data

US 2022/0195644 A1 Jun. 23, 2022

(30) Foreign Application Priority Data

Apr. 12, 2019 (IT) ..... 102019000005730

(51) Int. Cl.
*D04B 15/32* (2006.01)

(52) U.S. Cl.
CPC ..... *D04B 15/322* (2013.01)

(58) Field of Classification Search
CPC ..... D04B 15/322; D04B 15/34; D04B 35/32; D04B 15/32
See application file for complete search history.

(56) References Cited

U.S. PATENT DOCUMENTS 491,118 A * 2/1893 Kirkpatrick ..... D04B 15/32 66/57
3,670,528 A * 6/1972 Fregeolle ..... D04B 35/34 66/147

(Continued)

FOREIGN PATENT DOCUMENTS

CN 1108707 A * 9/1995 ..... D04B 35/28
CN 109355791 A 2/2019
EP 0314062 A1 * 5/1989 ..... D04B 15/32

OTHER PUBLICATIONS

Search Report dated Sep. 18, 2020 in corresponding International Application No. PCT/IB2020/053384, 5 pages.

(Continued)

*Primary Examiner* — Aiying Zhao
(74) *Attorney, Agent, or Firm* — MH2 TECHNOLOGY LAW GROUP LLP

(57) ABSTRACT

A support and control device to be mounted in a circular knitting machine provided with a supporting structure, a rotating component-holding unit, and a plurality of stitch formation components, includes a support body provided with a mounting portion having a front side and a rear side. The front side faces the component-holding unit and is provided with at least one cam defining a guiding path which interacts with respective butts of the stitch formation components. The device includes at least one through opening between the front side and the rear side, open on the guiding path, which defines an empty space placing the guiding path of the cam in direct communication with an outside of the device, so that the respective butts of the stitch formation components are facing, and in direct communication with, the empty space.

15 Claims, 13 Drawing Sheets

(56) References Cited

U.S. PATENT DOCUMENTS

| | | | | |
|---|---|---|---|---|
| 4,040,274 | A * | 8/1977 | Christopoulos | D04B 15/32 66/57 |
| 7,043,941 | B2 | 5/2006 | Willmer et al. | |
| 2006/0070408 | A1 * | 4/2006 | Willmer | D04B 35/32 66/8 |
| 2016/0102423 | A1 * | 4/2016 | Lonati | D04B 15/94 66/57 |

OTHER PUBLICATIONS

Written Opinion dated Sep. 18, 2020 in corresponding International Application No. PCT/IB2020/053384, 9 pages.

* cited by examiner

FIG.9
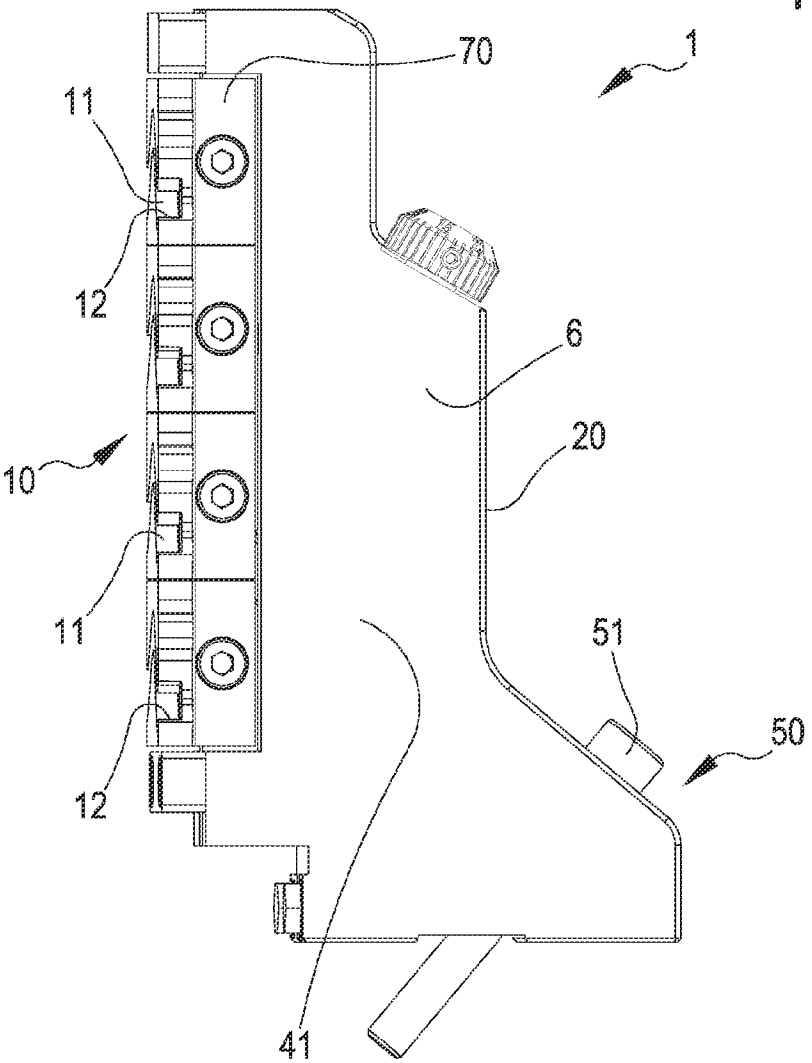
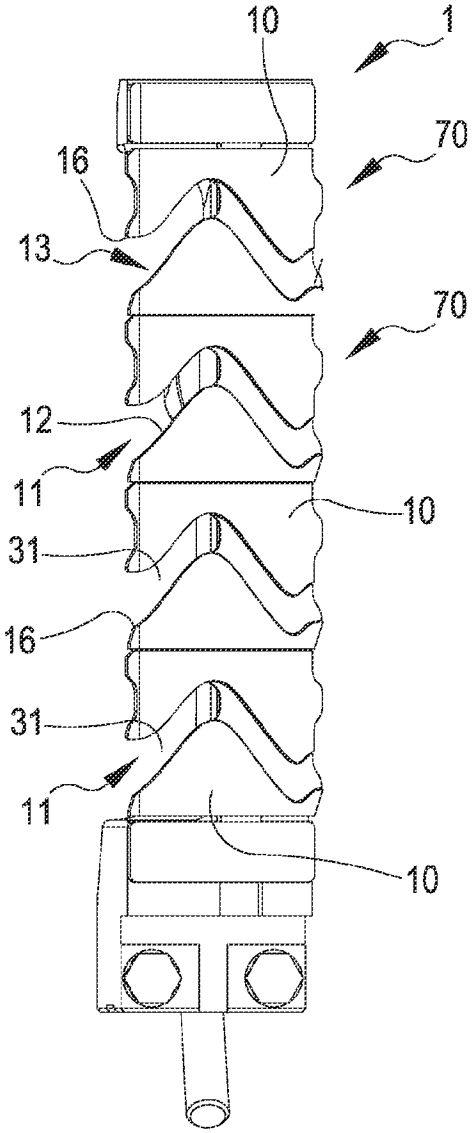
FIG.8

FIG.16
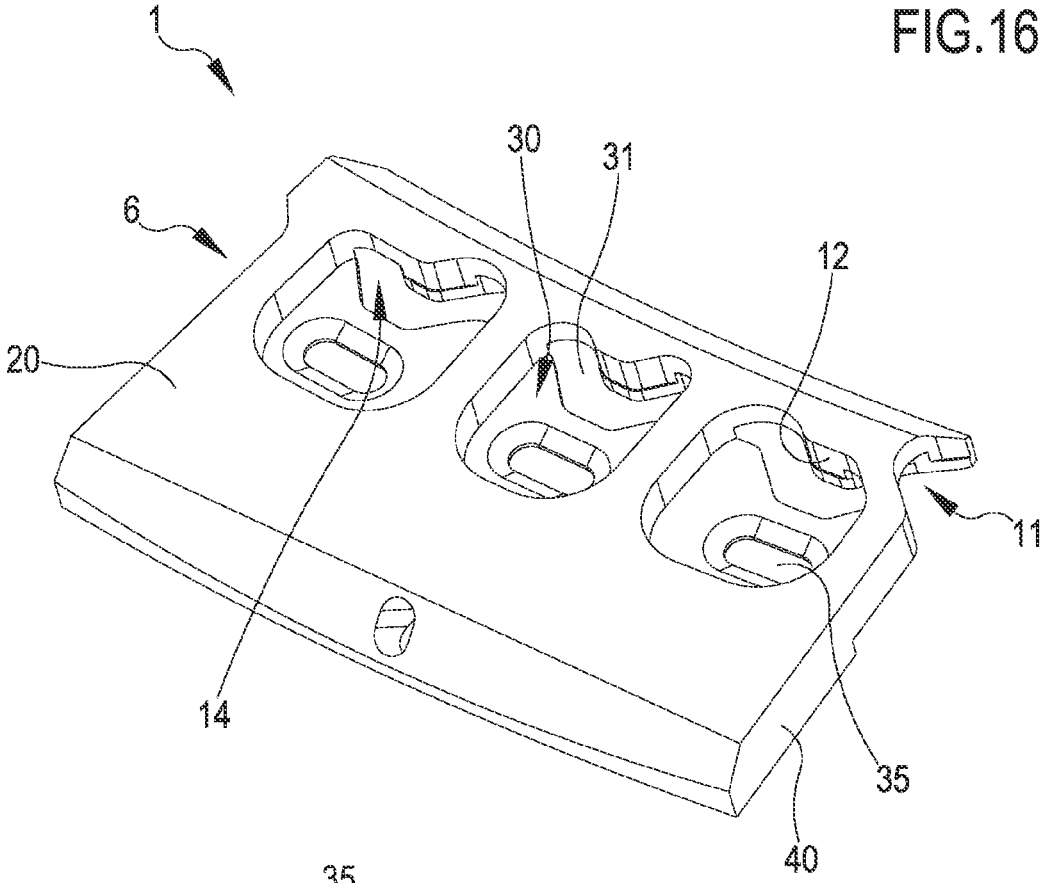
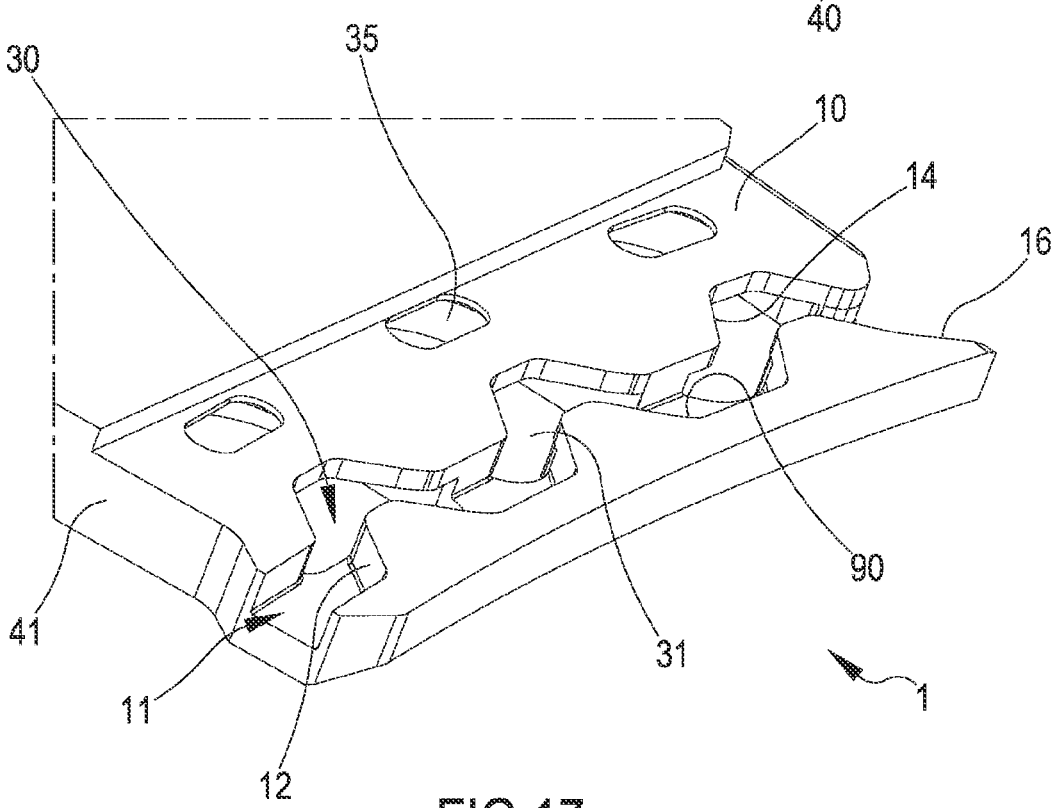
FIG.17

SUPPORT AND CONTROL DEVICE FOR CIRCULAR KNITTING MACHINES

CROSS-REFERENCE TO RELATED APPLICATIONS

This application is a U.S. National Stage application of PCT/IB2020/053384 filed Apr. 9, 2020, pending, which claims priority to Italian Application No. 102019000005730 filed Apr. 12, 2019, the entire disclosures of which are hereby incorporated by reference.

FIELD OF THE INVENTION

The present invention relates to a support and control device for circular knitting machines. In particular, the invention relates to a support and control device configured to interact with needles and/or knockover sinkers of a knitting machine, and characterized by a specific structure.

Furthermore, the present invention relates to a circular knitting machine comprising such a device.

BACKGROUND

The present invention relates to the technical field of circular knitting machines for knitwear, seamless knitwear, hosiery and the like.

In the present text, the term "knitting machine" generally means a circular knitting machine adapted for the production of textile articles and provided with at least one needle-holding unit or needle-holding cylinder rotatably mounted in a supporting structure of the machine and supporting, in suitable sliding compartments (or needle compartments) a plurality of needles movable parallel to an axis of rotation of the needle-holding cylinder to produce a knitted fabric.

Furthermore, the knitting machine is provided with a plurality of yarn feeding points, or yarn "feeds", in which the yarn is fed to the needles of the machine. Such a knitting machine can be, for example, of the single-bed or double-bed type. Circular knitting machines may comprise a variable number of feeds, for example 2, 4, 6, 8 or more yarn feeds.

In the field of circular knitting machines, different ways of controlling the needles are known. Typically, at each yarn feed, a series of components and devices are mounted on the knitting machine which are responsible for controlling the needles. These components and devices comprise at least one "stitch cam", which interacts with the butts of the needles to move them longitudinally (upwards and downwards), and in a controlled manner according to a specific law of motion, in the respective sliding compartment. The butts of the needles are positioned at a point in the longitudinal development of the needles themselves, and in such a way as to intercept the profile of the stitch cam in succession.

In knitting machines it is known to use structures which allow placing the different devices, and in particular the stitch cams, in the correct positions for interacting with the needles and for carrying out the knitting processes. A typical solution involves the use of a supporting block to be positioned on the frame of the knitting machine and on which one or more stitch cams or other control devices must be mounted. These blocks, called in jargon "sectors" or "skirts", or also "cam box" or "cam section", are substantially machined pieces that receive on them the stitch cams and possibly other devices (such as cams or lever devices for the control of needle selectors). The elements mounted to the block are positioned in a certain way with respect to the needle-holding unit.

Knitting machines comprise a plurality of the aforementioned blocks, typically one or more for each yarn feed; the number of blocks can also be very high, for example on large diameter knitting machines or with a high number of yarn feeds.

In the circular knitting machines there are also, in addition to the needles, a plurality of members called "knockover sinkers" or simply "sinkers", which collaborate with the needles in the formation of the stitches.

The sinkers are arranged between the needles of the cylinder and have the function of defining a supporting surface for the thread fed to the needles while the latter are forming a new knit loop and, subsequently, tensioning the knit loop against the stem of the needle while the latter is raised to take the thread to form a new knit loop, so as to safely cause the opening of the tongue of the needle while the knit loop is held on the stem of the needle.

In circular knitting or hosiery machines, the sinkers are housed individually within radial grooves defined in a ring of the sinkers (or crown of sinkers), which is fixed coaxially to the needle-holding cylinder in the vicinity of its upper end; the sinker ring rotates integrally with the cylinder.

Each sinker is located between two contiguous needles and is provided with at least one respective butt which protrudes superiorly from the relative groove of the sinker ring in which the sinker is inserted. The butt engages in paths defined by cams which are part of a sinker control device, called "sinker cover", facing above the sinker ring and also having an annular plan conformation; the sinker cover is fixed to the frame of the knitting machine and is therefore fixed with respect to the needle-holding cylinder, and is positioned coaxially thereto. By virtue of the above paths of the sinker cover, during rotation of the needle-holding cylinder around its axis, the sinkers are actuated with alternating motion each inside the respective groove.

This movement of the sinkers is necessary for the correct formation of the stitch: in particular, the sinkers are moved away from the axis of the cylinder to allow the needles, during their descent, to form new stitch loops so that the area of the thread or threads between two contiguous loops rest on the portion of the sinkers, usually flat and called "knockover plane", while the previously formed loops are "knocked down", i.e. left by the relative needle. During the knockover of the old loops, the sinkers are moved towards the axis of the needle-holding cylinder to engage with the new loops by means of a tang which overhangs the knockover plane, so as to obtain a retention and tensioning of the loops against the stem of the needles, as described above, to allow the correct opening of the tongue when the needles start a new ascent.

The movement of the sinkers is therefore obtained through the interaction between the butts of the sinkers and the path determined for them by a plurality of "sinker cams" present in the sinker cover, typically one for each yarn feed (or feeding point) of the knitting machine, which together define a complete annular path. The path defined by the sinker cams of the sinker cover has sections that approach and sections that move away from the axis of the cylinder in such a way as to cause, following the rotation of the cylinder itself (and therefore of the sinker-holding ring integral therewith) the alternating movement of the sinkers along the relative groove; by this movement, the sinkers assist the needles in the formation of the stitches.

Typically, the sinker cams have an external cam surface, facing outwards from the sinker cover, and an internal cam surface, facing towards the axis of the needle-holding cylinder.

The sinker cams which define the complete annular path of the sinker cover, in which the sinkers of the sinkers slide, are usually made as a plurality of blocks mounted side by side in succession along the entire circumference of the sinker cover, so as to form the complete annular path, which develops continuously around the needle-holding unit. Each block defines—on its lower surface—one or more portions of the path for the butts of the sinkers, and is made in such a way that the annular path section defined by it matches the respective annular path sections of the blocks adjacent to it, once mounted. The annular path then continues between one block and the next, and the butts of the sinkers travel the entire circumference of the sinker cover, passing continuously between the blocks in succession. Typically in each block the respective annular path section is made by mechanical machining, to obtain a "track" corresponding to the desired path portion.

The Applicant has found that the known knitting machines, both as regards the support blocks, or "skirts", carrying the stitch cams, and as regards the blocks on which the sinker cams are defined, are not free from drawbacks and can be improved in several ways.

A typical drawback of the known solutions is represented by the accumulation of fluff, filaments, dust, lubricating oil and dirt in general, which occurs at the skirts carrying the stitch cams and the blocks of the sinker cams. In fact, consider that during the operation of the knitting machine, the rubbing of the feeding threads with the needles, the sinkers and other members of the knitting machine generates a high quantity of fluff and filaments which, over time, collect and agglomerate, for example at surfaces and portions of the skirts and blocks. Furthermore, this fluff can be pressed, for example between the needles and the sinkers and the respective cams, and this pressure can generate, over time, hardened blocks or clusters in certain positions of the knitting machine. For example, in known machines the presence of these hardened clusters is found precisely at the paths of the stitch cams and the sinker cams, since these paths are made up of channels and hollow surfaces in which the fluff accumulates and from which it has difficulty to escape. The needles and sinkers that run, in succession and continuously, with their butts in the paths of the cams, generate pressure on the accumulated fluff and prevent it from being ejected. The accumulation of fluff, dust and external material can also be found in the fixing holes of the aforementioned skirts and blocks, which end up being "plugged".

The accumulation of pressed fluff and clusters determines a series of major drawbacks. First of all, accumulations of fluff, which can also have a high hardness due to the continuous pressure, interfere with the moving parts, for example with the butts of needles and sinkers or with the stems of these components. This interference generates friction and is an obstacle to the free movement of needles and sinkers and to the rotation of the needle-holding and sinker-holding units. Furthermore, the accumulations reduce the free space in the paths of the cams, and this also increases friction and chafing with the moving parts. Overall, the Applicant has verified that the knitting machine—as the accumulation of fluff and dust increase—needs an ever increasing amount of electricity, as rotation and handling become increasingly difficult due to friction. In essence, the motors that move the needle-holding unit and the sinker-holding unit are increasingly stressed and more power is therefore required. This translates into a very substantial increase in energy consumption for the operation of the knitting machine. Furthermore, the higher power required increases the wear phenomena and can lead to early failures or malfunctions in the knitting machine, or in any case to a reduction in the useful life of the components.

A further drawback, combined with the increase in friction and electricity consumption, is represented by the considerable overheating of the motors and the components of the knitting head. This overheating is harmful and can lead to breakdowns or malfunctions.

It should be considered that these phenomena become even more relevant in cases where the knitting machine must operate at high production speeds and continuously for prolonged periods of time.

In addition to the above, consider that in any case the accumulation of fluff, especially if hardened, in particular by heat, at a certain point necessarily requires cleaning and maintenance. This constitutes a serious drawback, since these activities are very complex, require specialized personnel, force to stop the knitting machine and require long execution times. In addition to stopping the knitting machine, it is also necessary to disassemble numerous members of the knitting head, for example all the skirts of the stitch cams and all the blocks of the sinker cams, to free the accumulations of fluff and carry out cleaning. The Applicant has verified that even after disassembling the components, cleaning is complex since the hardened fluff is blocked; often it is even necessary to use tools or cutters to remove the clusters, as well as to rectify and repair certain operating surfaces (for example sections of the cam) damaged by friction.

It should also be noted that the disassembly and maintenance operations, very frequent due to the continuous accumulation of fluff, can cause reassembly errors, which translate into positioning errors of the components. This is a drawback of great importance in the knitting machinery sector, since incorrect assembly, for example of the cams—even the smallest ones—entails an incorrect interaction with the needles and the sinkers, and therefore errors or inaccuracies in the textile processing. Therefore, every cleaning and maintenance operation requires complex and difficult operations of adjustment and reconfiguration of the cams with respect to the needle-holding unit.

In addition to all the drawbacks illustrated above, the Applicant has found that accumulations of fluff, and operation in conditions of an unclean machine, can lead to frequent failures in needles, sinkers and other components, and can also introduce errors in the formation of the stitch and determine deterioration in the quality of the knitted fabric produced.

The Applicant has also observed that the known solutions, in particular the support blocks, or "skirts", carrying the stitch cams, have big limits in the definition of the cam paths, due to the conformation of the blocks themselves and the presence of assembly means.

In this situation, the object of the present invention, in its various aspects and/or embodiments, is to provide a support and control device which can be able to overcome one or more of the mentioned drawbacks.

A further object of the present invention is to provide a support and control device capable of avoiding or limiting the phenomena of accumulation of fluff, dust or dirt inside the knitting head.

A further object of the present invention is to provide a support and control device capable of reducing the energy consumption associated with the movement of the needle-holding unit and the sinker-holding unit.

A further object of the present invention is to provide a support and control device capable of limiting the friction and overheating phenomena of the knitting head.

A further object of the present invention is to provide a support and control device capable of reducing machine stops and the need to perform cleaning and maintenance operations on the knitting head.

A further object of the present invention is to provide a support and control device capable of simplifying the cleaning and/or maintenance operations of the knitting head.

A further object of the present invention is to provide a support and control device characterized by a high reliability of operation and/or by a lower predisposition to failures and malfunctions.

A further object of the present invention is to provide a support and control device characterized by a simple and rational structure.

A further object of the present invention is to provide a support and control device which increases the possibilities of defining and sizing the paths of the cams, according to the different textile requirements and the laws of motion that it is desired to impart to needles and/or sinkers.

A further object of the present invention is to provide a support and control device capable of being mounted to the knitting head in a simple manner.

A further object of the present invention is to provide a support and control device characterized by a low manufacturing cost with respect to the performance and quality offered.

A further object of the present invention is to create alternative solutions, with respect to the prior art, in the implementation of support and control devices for circular knitting machines, and/or open new design fields.

A further object of the present invention is to provide a support and control device for circular knitting machines capable of allowing a new design of the needle and sinker control devices.

A further object of the present invention is to provide a needle support and control device for circular textile machines characterized by an innovative structure and configuration with respect to the prior art.

SUMMARY

These objects and any others which will become more apparent in the course of the following description, are substantially achieved by a support and control device according to one or more of the appended claims, each of which taken alone (without the relative dependent ones) or in any combination with the other claims, as well as according to the following aspects and/or embodiments, variously combined, also with the aforementioned claims.

In the present description and in the appended claims, the terms "upper", "superiorly", "lower", "inferiorly", "vertical", "vertically", "horizontal", "horizontally", refer to the positioning of the machine in normal operation, with the central rotation axis placed vertically and the needles of the cylinder with the head facing upwards.

In the present description and in the appended claims, the terms "axial" and "circumferential" refer to the aforementioned central axis.

Aspects of the invention are listed below.

In a first aspect, the invention relates to a support and control device for circular knitting machines.

In particular, the device is destined to be mounted in a circular knitting machine equipped with at least one supporting structure, at least one component-holding unit and a plurality of stitch formation components movably associated with the component-holding unit.

In one aspect, the device comprises at least one support body provided with:

- a mounting portion configured for allowing the device to be mounted to the supporting structure of the circular knitting machine;
- a front side;
- a rear side.

In one aspect, the front side faces towards and is directly facing said component-holding unit of the knitting machine and provided with at least one cam for controlling at least a part of said plurality of stitch formation components, said at least one cam defining a guiding path configured for interacting with respective butts for controlling each of the stitch formation components of said at least a part of said plurality of stitch formation components;

In one aspect, the rear side is opposed to said front side and facing the outside of the knitting machine, away from said component-holding unit.

In an independent aspect of the present invention, the device comprises at least one through opening between said front side and said rear side, open on at least a portion of said guiding path.

In one aspect, said through opening defines an empty space placing at least a portion of said guiding path of said at least one cam in direct communication with the outside of the device (and of the knitting machine), at least in an operating configuration of the device, so that the respective butts of the stitch formation components interacting with the cam face and are in direct communication with said empty space.

The Applicant has verified that the invention allows solving the problems set out above related to the prior art and therefore to achieve the set objects.

In particular, the Applicant has verified that the invention allows preventing or strongly limiting the phenomena of accumulation of fluff, dust or dirt inside the knitting head, allowing an easy ejection and removal thereof.

The Applicant has also verified that the invention allows limiting the cleaning and maintenance operations of the knitting machine, and considerably reducing energy consumption.

Further aspects of the invention are listed hereinafter.

In one aspect, the expression empty space means a space between said front side and said rear side and free of the material with which said support body of the device is made.

In one aspect, the expression "facing, and in direct communication with, said empty space" means that the butts of the stitch formation components interacting with the cam are accessible and reachable from the outside of the device, in particular from said rear side.

In one aspect, each of said stitch formation components is provided with a respective butt, configured to interact with said at least one cam.

In one aspect, said component-holding unit is configured to rotate around a central axis of the knitting machine, to impart a roto-translational motion to said stitch formation components so as to achieve the formation of the stitch.

In one aspect, said guiding path of the cam is active, in succession, on the butts of the stitch formation components which interact, in sequence and due to the rotation of the component-holding unit, with the cam of the device.

In one aspect, said through opening is open both on the front and on the rear.

In one aspect said through opening is configured to allow the ejection, from said rear side, of fluff, filaments and dust accumulated or generated at said front side (for example at said at least one cam).

In one aspect, said given area of the through opening has such an extension and a shape as to simultaneously involve and be simultaneously in communication with a plurality of butts of stitch formation components interacting in sequence with the guiding path of the cam, so that said plurality of butts is simultaneously in direct communication with said empty space defined by the through opening.

In one aspect, said plurality of butts simultaneously in direct communication with said empty space comprises at least 2 or at least 5 or at least 10 or at least 20 or at least 50 butts.

In one aspect, the body portion of the device affected by said through opening and by said empty space is greater than the body portion of the device without a through opening (i.e. the body portion of the device in which the front side and the rear side are connected by solid material). In other words, preferably the through opening between the front side and the rear side is greater than the part of the body in which the passage from the front side to the rear side is closed (due to the material itself that makes up the device body).

In one aspect, said given area of the through opening has such an extension and a shape as to simultaneously involve and be simultaneously in communication with, a number of butts of stitch formation components greater than the number of butts interacting with the cam guiding path but not in direct communication with the empty space defined by the through opening. In other words, preferably the number of butts "exposed" in the through opening, that is in communication with said empty space, is greater than the number of butts "covered" by the material of the device body, that is, not in communication with the through opening.

In one aspect, the expression front side means a side (or surface) operatively facing the component-holding unit, that is, facing it and directed towards it, so that the stitch formation components associated with the component-holding unit interact with said front side.

In one aspect, the expression rear side means a side (or surface) geometrically opposite to the front side and not operationally related to the component-holding unit, i.e. not facing it and facing away from it, in such a way that the stitch formation components associated with the component-holding unit do not interact with said rear side.

In one independent aspect of the present invention, said front side is free of undercuts or holes or concave surfaces facing said component-holding unit (obviously with the exception of the cam guiding path).

In one aspect, said front side has a smooth or planar surface (except for said guiding path), facing said needle-holding unit.

In one aspect, said front side is free of mounting members or means.

In one aspect, the front side of the device may comprise a plurality of cams for controlling said plurality of stitch formation components, each cam defining a respective guiding path configured for interacting with the butts controlling one or more of said stitch formation components.

In one aspect, the invention provides for the absence of mounting members or means on the part of the device facing the component-holding unit.

In one aspect, the device comprises at least one door configured to be mounted, preferably in a removable way, to the rear side of the device body, so as to selectively close, in certain operating conditions of the device, said through opening at the rear side. In one aspect, the door is mountable to the body or removable from the body respectively to prevent access, or to allow access, to said empty space defined by the through opening. When the door is not present, the device operates in an operative configuration in which at least a portion of said guiding path of said at least one cam is in direct communication with the outside of the device, through said empty space.

In one aspect, said component-holding unit is a rotating needle-holding unit (needle cylinder or needle plate), said plurality of stitch formation components is a plurality of needles, and said supporting structure is a mounting ring external to the needle-holding unit and integral with (or part of) the base of the knitting machine.

In one aspect, said through opening is laterally open on, i.e. it laterally ends on, said first side face or said second side face.

In one aspect, said through opening is laterally comprised between the first side face and the second side face, without leading or ending laterally on said first side face or said second side face.

In an independent aspect of the present invention, said cam is defined on a removable cam body mountable to the device body, so that the guiding path is defined on said front side.

In one aspect, said cam body comprises a front portion, on which said guiding path is defined, and a fastening portion, placed laterally to said front portion and provided with means for fastening the cam body to a side face of the device body.

In one aspect, said cam body has an overall L-shape, consisting of said front portion and said fastening portion, integral with each other and forming an angle between them, preferably 90°. The L-shape is observable along sections on transverse planes of the cam body, on which the angle between the front portion and the fastening portion is defined.

In one aspect, said front portion and said fastening portion of the cam body are in one piece.

In one aspect, the proportion, in the cam body, between the volume of the fastening portion and the volume of the front portion is at least ⅙ or at least ¼, or at least ⅓ or at least ½.

The Applicant has observed that the embodiment of the device which provides a removable cam body which can be mounted on the device body and is provided with a front portion and a side fixing portion, allows overcoming the typical limits of the known solutions, in terms of the possibility of definition of the cam guiding paths, and exploiting the entire surface of the front portion to shape the guiding path.

In one aspect, the front side of the device may comprise a plurality of stitch cams for controlling the needles, each cam defining a respective guiding path configured to interact with the control butts of a given sub-group of needles. Preferably, said plurality of stitch cams is defined on a corresponding plurality of cam bodies mounted on the front side of the device body.

In one aspect, the stitch cams of said plurality of stitch cams are arranged, on the front side, superimposed on each other according to a vertical succession, that is in sequence one above the other, so as to create a plurality of guiding paths parallel to each other, each cam being configured to interact with the butts of a given sub-group of needles provided with a butt placed at a certain height such as to interact with the guiding path of the cam.

In one aspect, said component-holding unit is a rotating sinker-holding unit (sinker ring or crown), said plurality of stitch formation components is a plurality of knockover sinkers, and said supporting structure is a sinker cover placed above or below the sinker-holding unit, that is, a supporting ring integral with (or part of) the base of the knitting machine.

In one aspect, said at least one cam, defined on said front side, is a sinker cam for controlling the sinkers, configured to interact with the butts of the sinkers in transit due to the rotation of the sinker-holding unit.

In one aspect, the device comprises suction members configured to generate a depression at said empty space defined by the through opening, so as to cause suction in a direction from said front side towards said rear side and towards the outside of the device.

In one aspect, said suction members comprise at least one suction nozzle applicable frontally, preferably removably, to the rear side of the device body, said nozzle being counter-shaped to the shape of the area of said through opening at the rear side.

In one aspect, said suction nozzle has a tubular shape and extends between a front end, configured to be applied frontally to the rear side of the device body, and a rear end, configured to be fluidly connected to suction means, for example to a vacuum cleaner, a compressor, a fan or a vacuum pump.

In one aspect, the device comprises said suction means.

In one aspect, the knitting machine comprises the aforesaid suction members, and preferably comprises said nozzle and said suction means, wherein the nozzle can be selectively positioned at the through opening of a support and control device and said suction means are activatable selectively to perform an aspiration towards the rear side and therefore inside the nozzle, to perform a cleaning of the support and control device.

In one aspect, said support body is in one piece or monobloc.

In one aspect, the device constitutes a skirt or sector of a circular knitting machine, configured to support the control members associated with a given yarn feed, or yarn feeding point, in which the yarn is fed to the needles of the machine.

In one aspect, the device body is configured to exhibit a structural rigidity, despite the presence of the through opening, sufficient to avoid—in conditions of use—bending, in particular with respect to a plane parallel to the front or rear side, or vibratory phenomena.

In an independent aspect thereof, the present invention relates to a support and control device for circular knitting machines, destined to be mounted in a circular knitting machine equipped with at least one supporting structure, with at least one component-holding unit rotating around a central axis of rotation, and with a plurality of stitch formation components movably associated with the component-holding unit, the device comprising at least one support body provided with:

a mounting portion configured for allowing the device to be mounted to the supporting structure of the circular knitting machine;

a front side facing towards and is directly facing said component-holding unit of the knitting machine, the front side being provided with at least one cam for controlling at least a part of said plurality of stitch formation components, said at least one cam defining a guiding path configured for interacting with respective butts for controlling each of the stitch formation components of said at least a part of said plurality of stitch formation components;

a rear side, opposed to said front side and facing the outside of the knitting machine, away from said component-holding unit;

wherein said cam is defined on a cam body removably mountable to the body of the device, so that the guiding path is defined on said front side, and wherein said cam body comprises a front portion on which said guiding path is defined, and a fastening portion placed laterally to said front portion and provided with means for fastening the cam body to a side face of the body of the device.

In an independent aspect thereof, the present invention relates to a circular knitting machine for knitting or hosiery comprising at least a support and control device according to one or more of the aforementioned aspects and/or claims.

In one aspect, the knitting machine comprises:

a supporting structure;

at least one component-holding unit turnably mounted in said supporting structure so as to rotate around a central axis of rotation;

a plurality of stitch formation components movably inserted into sliding compartments of the component-holding unit and moving so as to produce a knitted fabric.

In one aspect, the knitting machine comprises a plurality of feeds or yarn feeding points on which the yarn is supplied to the machine needles, the feeds being positioned circumferentially around the component-holding unit and angularly spaced from each other.

In one aspect, the mounting portion of the support body of the support and control device, included in the knitting machine, is integral with said knitting structure, so that the device is in a certain position with respect to a respective feed of said plurality of feeds.

In one aspect, said component-holding unit has the structure and function of a needle-holding cylinder or a needle-holding plate or a sinker-holding unit.

In one aspect, the knitting machine comprises a plurality of support and control devices, each of them being associated with a respective feed.

In one aspect, the circular knitting machine comprises a plurality of support and control devices, positioned circumferentially around said component-holding unit.

In one aspect, the knitting machine comprises a plurality of substantially identical support and control devices.

In one aspect, the circular knitting machine is of the type with non-braked stitch formation components, i.e. each stitch formation component, movably inserted into the respective sliding compartment of the needle-holding unit, does not have any such braking means or such geometric features as to keep it autonomously in a given longitudinal position within the sliding compartment, but its longitudinal position in the compartment is determined and maintained by the respective butt engaged into the guiding path of the cams.

In other words, a stitch formation component (needle or sinker) is defined as "braked" when it has geometric qualities (for example a permanent curvature) or means (for example foils or springs) which—once the component is inserted in the respective sliding compartment—cause "braking" thereof inside the compartment itself, that is, a stable condition even in the absence of external elements (such as a guiding cam) that keep it in position. The geometric qualities or the aforesaid means, in fact, generate a thrust of the components on the walls of the respective compartment, which avoid a movement (typically downwards) of the component in the compartment, and a change of position. The "unbraked" components, on the other hand, are the stitch formation components (needles or sinkers) that do not have geometric features or means that keep them in position in the respective compartment, but constantly need to be guided and held in position, typically by a guiding cam (which engages the control butt thereof). In the absence of this external guide, the stitch formation component typically descends into the compartment or in any case moves to a different unguided position.

In one aspect of the present invention, the knitting machine has unbraked stitch formation components and comprises a plurality of support and control devices placed circumferentially all around said component-holding unit and in continuous sequence one after the other, so that the plurality of guiding paths of the control device globally creates a continuous, complete circular track having a closed annular shape developing around the central axis.

In one aspect, the end of each guiding path of each supporting and control device of the knitting machine leads to the beginning of the guiding path of the following support and control device, so that the guiding paths continue to form said continuous circular track.

In other words, each cam (i.e. each cam path) ends with a "funnel" outlet, and matches and continues in the next cam, so that the butts can travel continuously, for successive rotations of the knitting machine, said continuous circular track, passing in succession all the support and control devices.

In essence, the knitting machine is preferably, but not exclusively, of the unbraked needle type with a continuous and complete track (circular cam path). In one aspect, the plurality of support and control devices, placed side by side or joined one to the other, globally creates a cylindrical or annular unitary structure around or on said needle-holding unit.

In one aspect, the knitting machine comprises, between each pair of adjacent support and control devices, a connection element or a gasket, so as to define continuous joints between the adjacent devices.

In one aspect, there is no free space (laterally) between each pair of adjacent support and control devices.

In one aspect, the circular knitting machine is of the unbraked needle type.

In one aspect, the sinker-holding unit is a crown (or ring) arranged around the needle-holding cylinder, rotating integrally thereto around the central axis, and having a plurality of grooves, preferably radial, and the supporting structure is a fixed sinker cover located above the crown.

In one aspect, each sinker of said plurality of knockover sinkers is housed in one of the grooves and is movable, preferably radially, in the respective groove, each knockover sinker having a prong configured to cooperate with the needles and a butt engaged with the guiding path defined by the sinker cams of the support and control devices, so that the guiding path moves the knockover sinker along the respective groove when the crown rotates with respect to the sinker cover and around the central axis.

The overall guiding path of the sinker cover, defined by the succession of support and control devices of the sinker cover, constitutes a circular track having a closed annular conformation and developing around the central axis.

In one aspect, the circular knitting machine may be an argyle machine, i.e. a machine configured to make fabrics with inlay designs (intarsia machine or argyle machine).

In one aspect, the circular argyle knitting machine comprises at least two yarn feeds, each configured to work with a respective group of needles arranged along an arc of a circle by means of an alternating rotary motion of the needles around the central axis.

In one aspect, said at least two feeds combine to form each row of stitch by rotating in the two directions.

In one aspect, at least one motor is operatively connected to the needle-holding cylinder and to the crown to rotate them around the central axis.

In one aspect, the machine comprises a plurality of yarn feeds, preferably at least one, more preferably two or four or eight or sixteen.

Each of the above aspects of the invention can be taken alone or in combination with any of the claims or other aspects described.

BRIEF DESCRIPTION OF THE DRAWINGS

Further features and advantages will become more apparent from the detailed description of some preferred but non-exclusive embodiments, among which also a preferred one, of a support and control device according to the present invention. Such description is given hereinafter with reference to the accompanying drawings, provided only for illustrative and, therefore, non-limiting purposes, in which:

FIG. 4 shows some needles, of an exemplary type, interacting with the devices and belonging to a needle-holding cylinder (not shown);

FIG. 8 shows a front view of the support and control device of FIG. 7;

FIG. 9 shows a side view of the support and control device of FIG. 7;

FIG. 12 shows some sinkers, of an exemplary type, interacting with the device and belonging to a sinker-holding ring (not shown);

FIG. 16 shows a rear, partially exploded perspective view of the support and control device of FIG. 14;

FIG. 17 shows a bottom perspective view of the support and control device as shown in FIG. 16;

DETAILED DESCRIPTION

Figure 1:
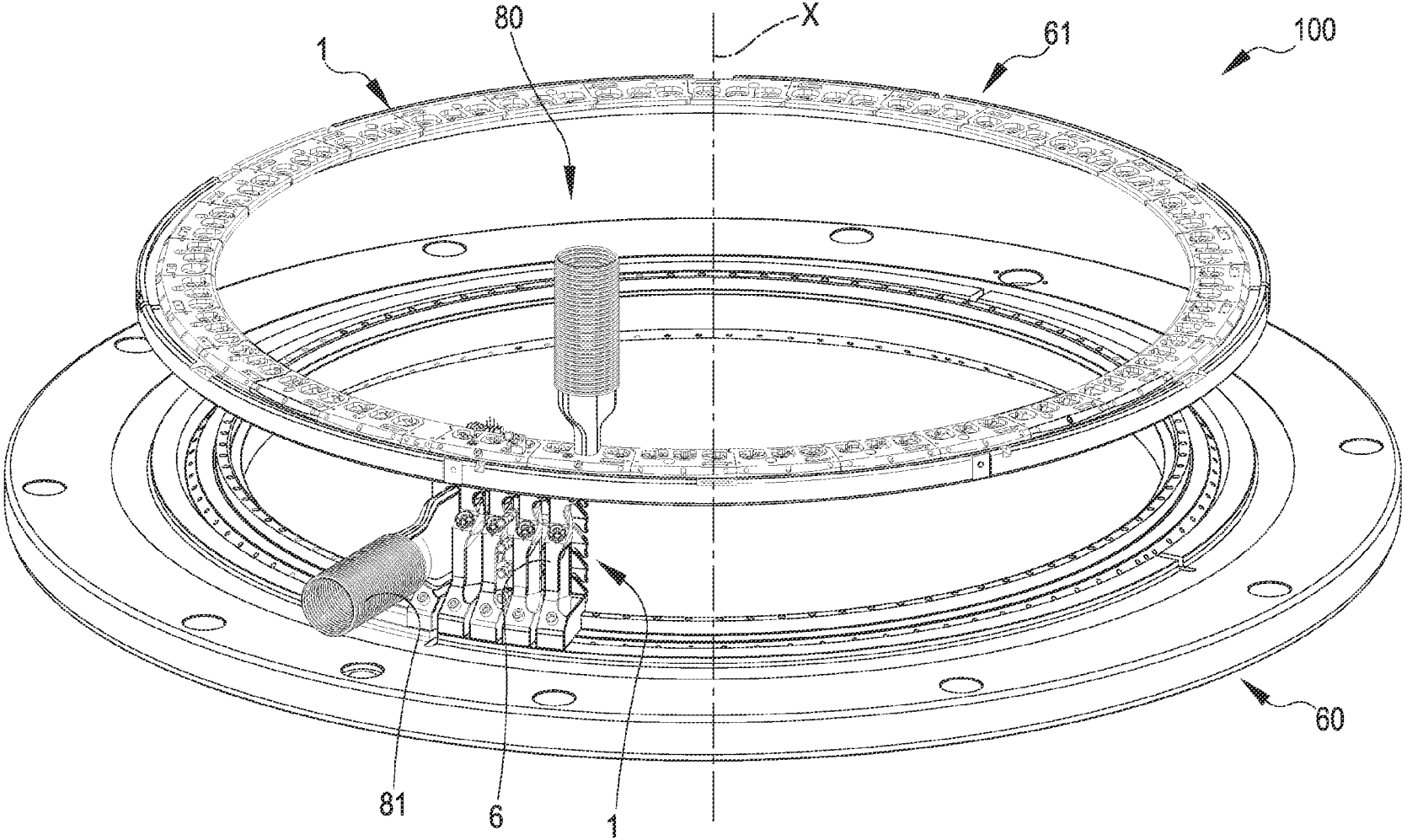
FIG. 1 shows a perspective view of a knitting head portion of a circular knitting machine, with some parts removed, provided with a plurality of support and control devices for circular knitting machines according to the present invention, according to two embodiments (one for the control of the needles, the other for the control of the sinkers) which will be described in detail below.

With reference to the aforementioned figures, the reference numeral 1 generally indicates a support and control device for circular knitting machines according to the present invention. In general, the same reference numeral is used for identical or similar elements, possibly in their embodiment variants.

With reference to the aforementioned figures, the reference numeral 100 generally indicates a portion of a knitting head of a circular knitting machine according to the present invention, with some parts removed to better show others. The knitting head 100 comprises one or more component-holding units, typically a needle-holding cylinder and/or a needle-holding plate and/or a sinker-holding ring, as will appear in greater detail below. The knitting head further comprises a plurality of stitch formation components, movably associated with a respective component-holding unit; the stitch formation components may be needles, feed sinkers or other members which cooperate for the formation of the stitch.

Figure 2:
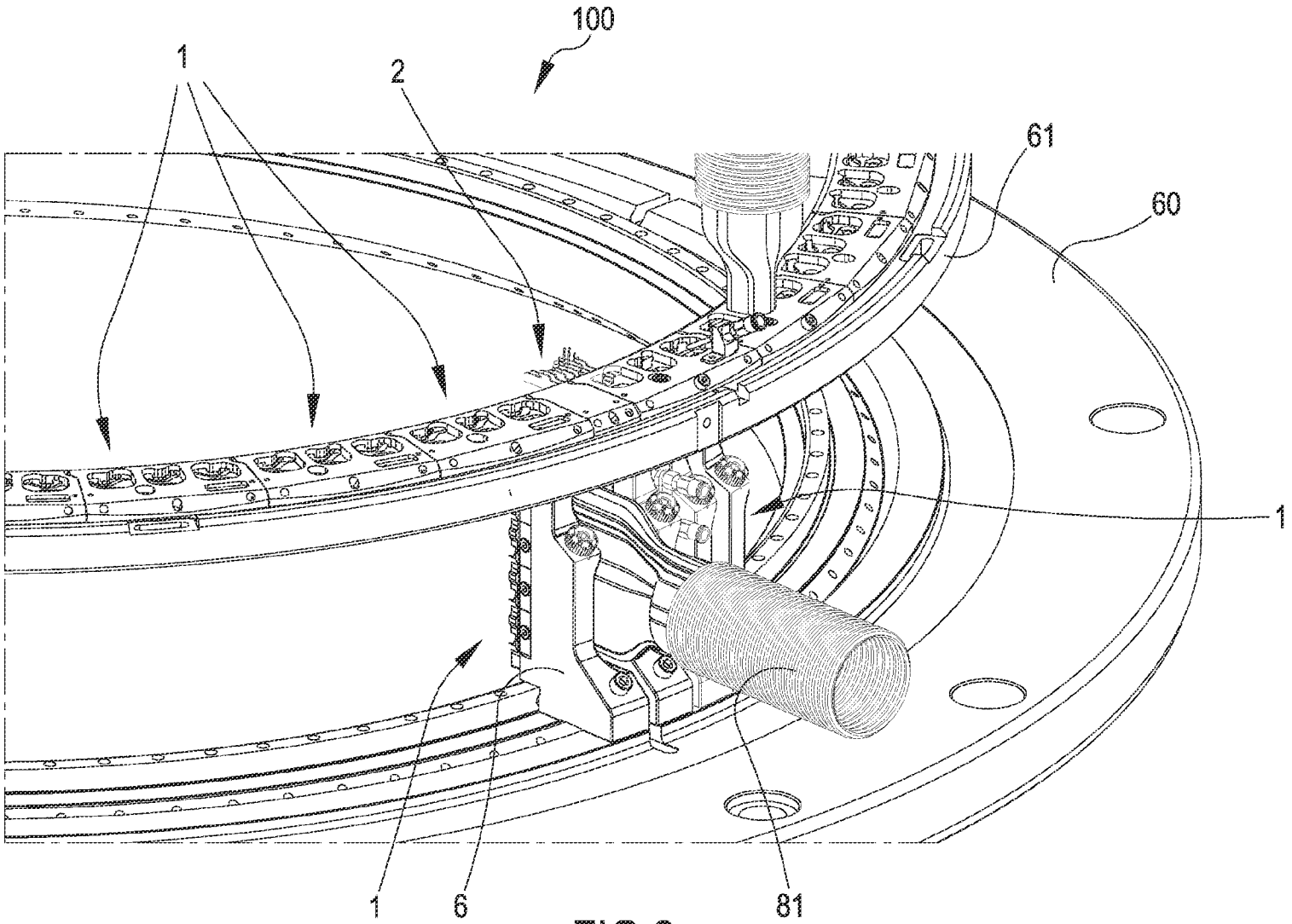
FIG. 2 shows a further enlarged perspective view of the knitting head of FIG. 1, from a different angle, with a plurality of support and control devices for circular knitting machines according to the present invention.
Figure 3:
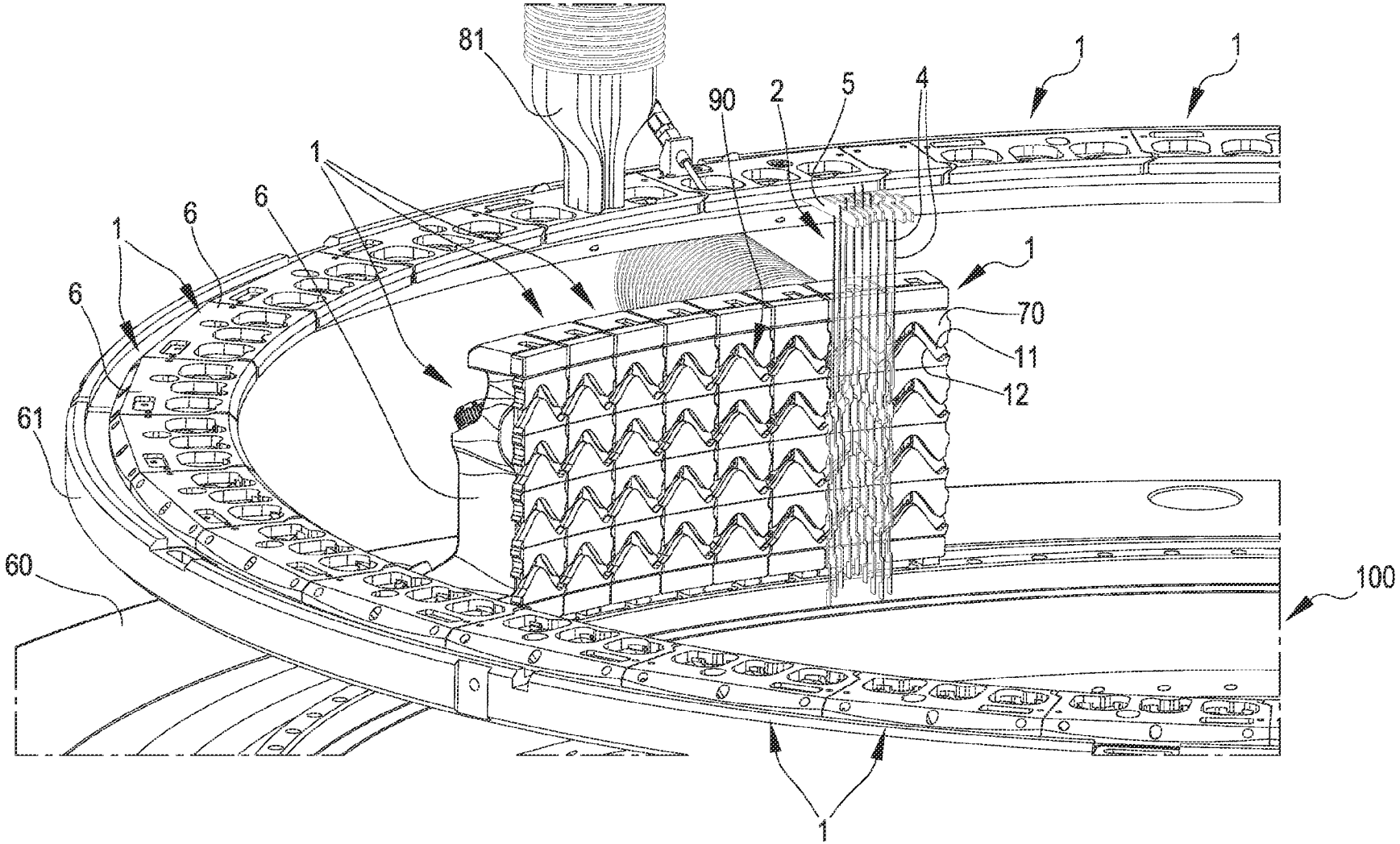
FIG. 3 shows a further rear perspective view of the knitting head of FIGS. 1 and 2.
Figure 4:
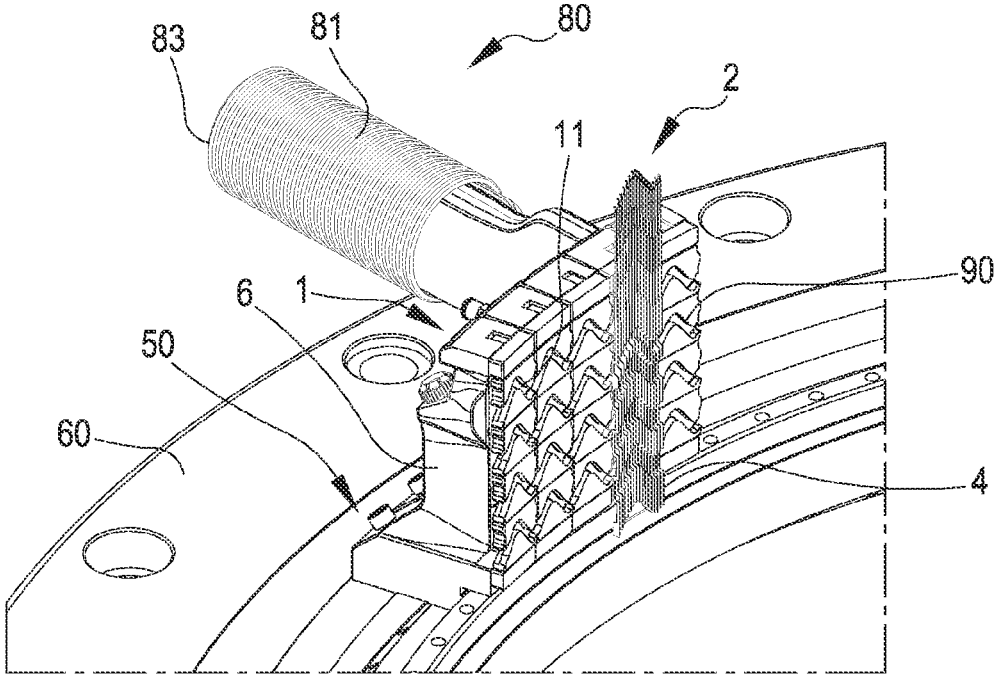
FIG. 4 shows a rear perspective view of the knitting head of FIG. 1, with some parts removed and showing a plurality of support and control devices according to a first embodiment of the present invention, this embodiment relating to a device for the control of needles.
Figure 5:
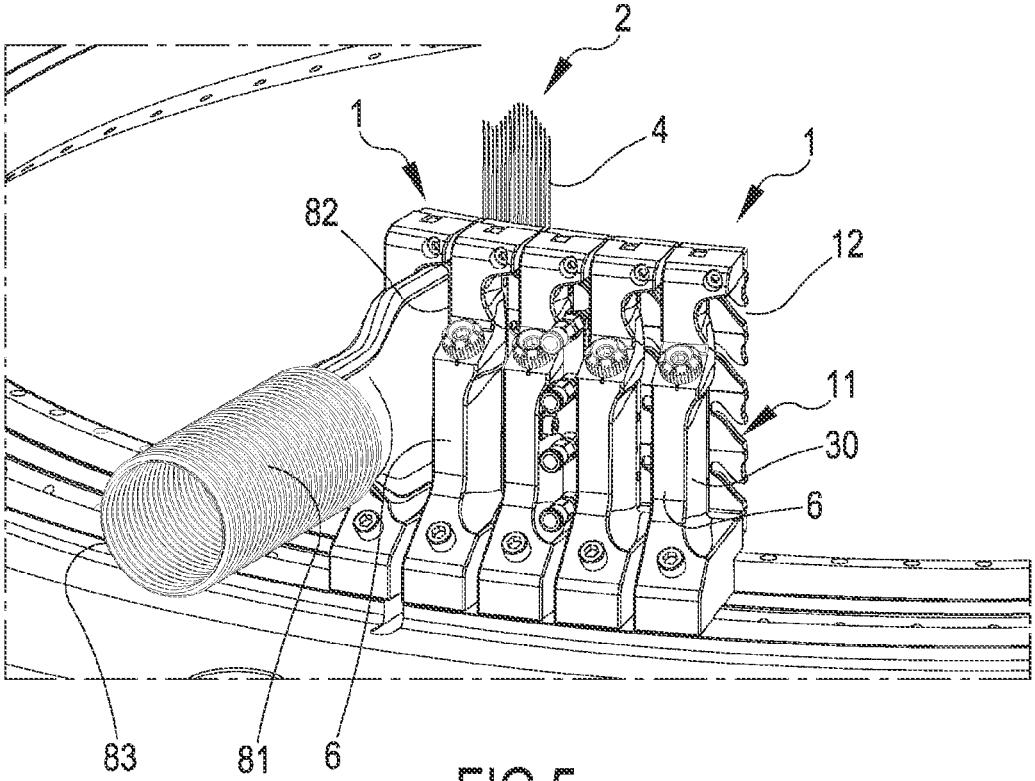
FIG. 5 shows a front perspective view (i.e. from inside the needle-holding cylinder) of the plurality of support and control devices of FIG. 4.
Figure 12:
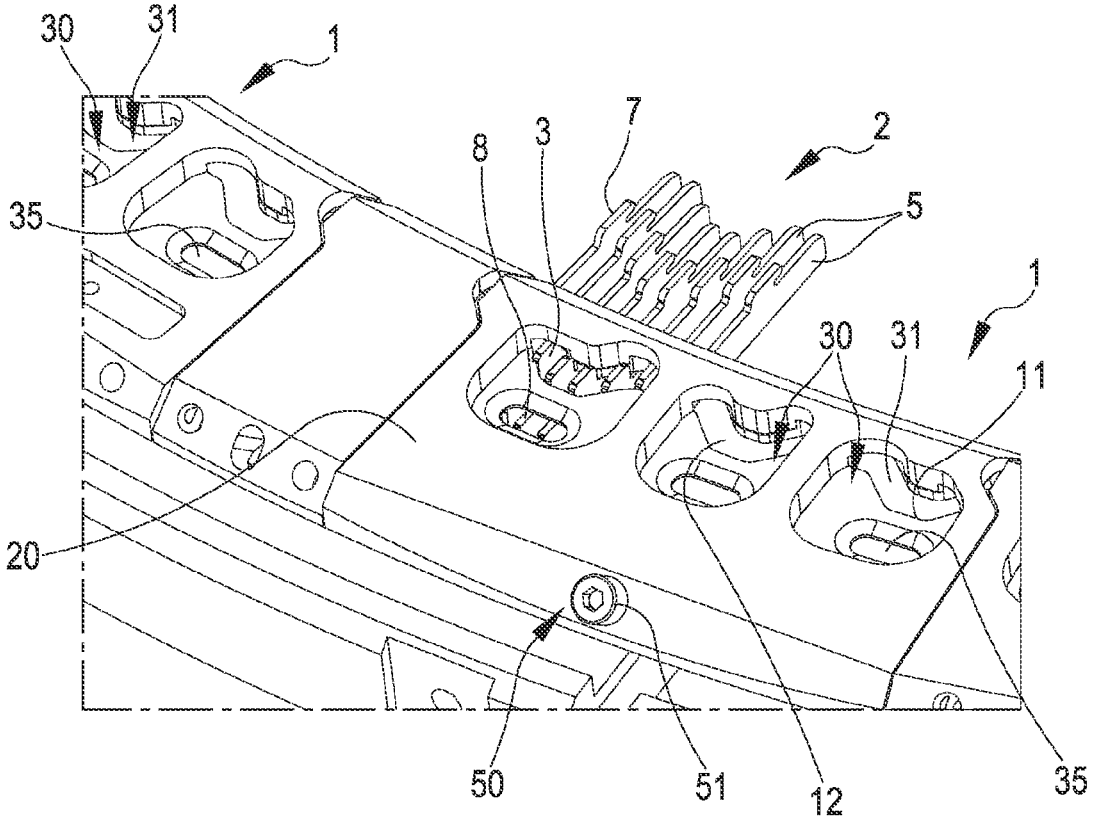
FIG. 12 shows a rear perspective view of a portion of the knitting head of FIG. 1, showing a support and control device according to a second embodiment of the present invention, this embodiment relating to a device for controlling sinkers.
Figure 13:
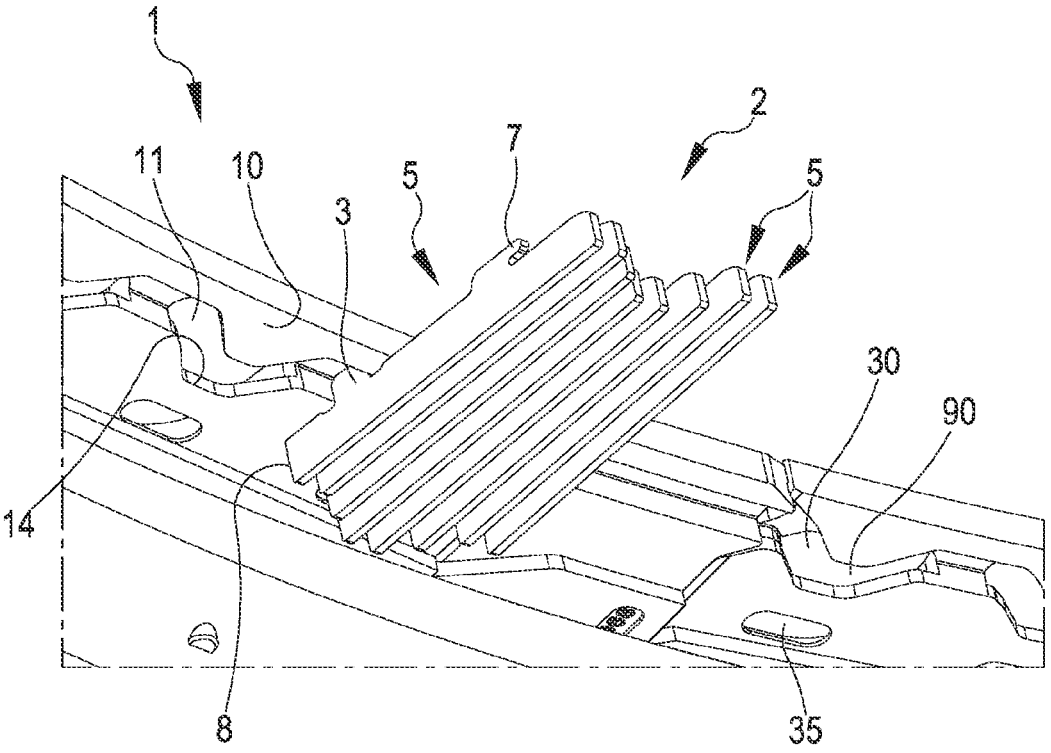
FIG. 13 shows a front perspective view (i.e. from inside the sinker-holding ring), of the support and control device of FIG. 12.
Figure 14:
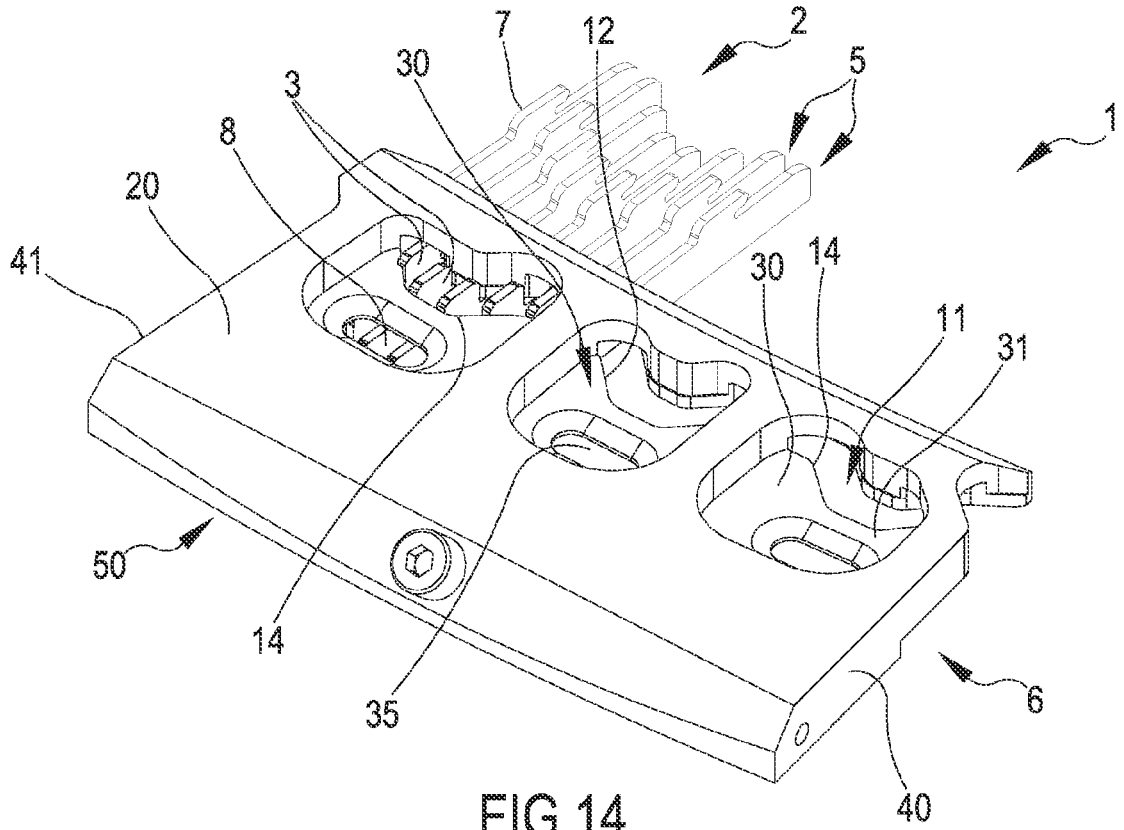
FIG. 14 shows a rear perspective view of a support and control device as in FIG. 12, and also shows a plurality of sinkers, of an exemplary type, while interacting with such a device in conditions of use in a circular knitting machine.
Figure 15:
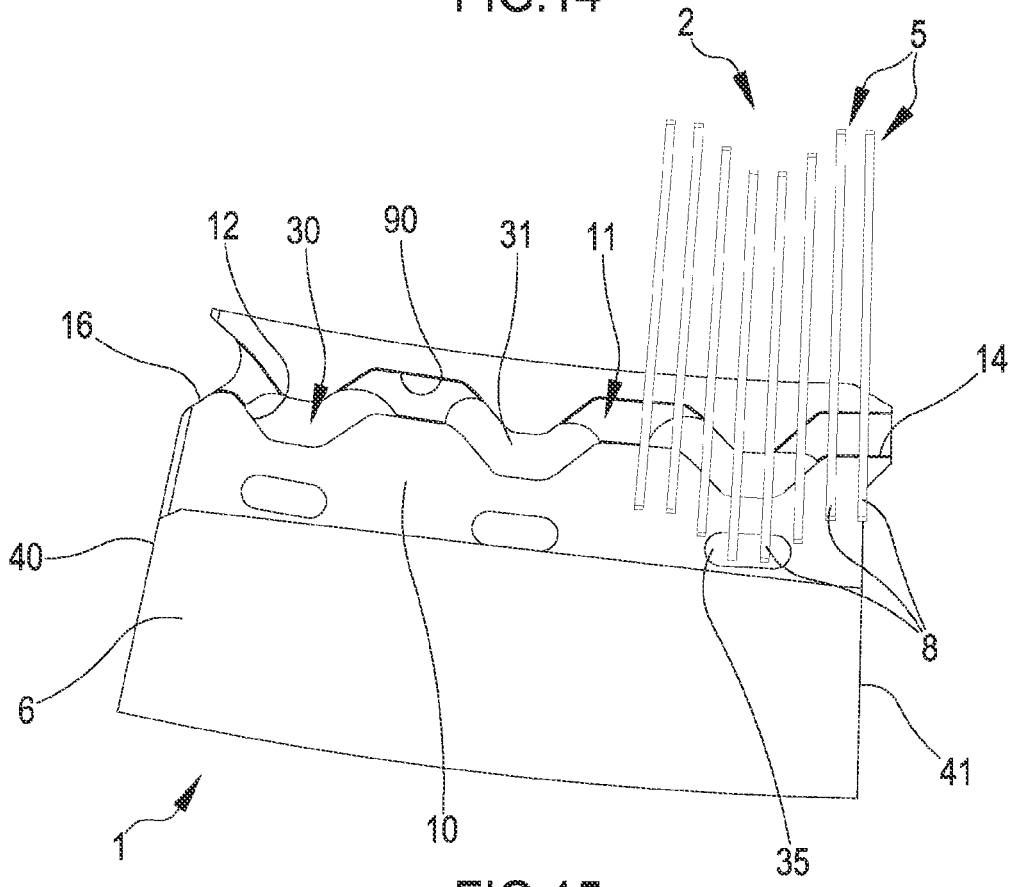
FIG. 15 shows a bottom view of the support and control device of FIG. 14.
Figure 18:
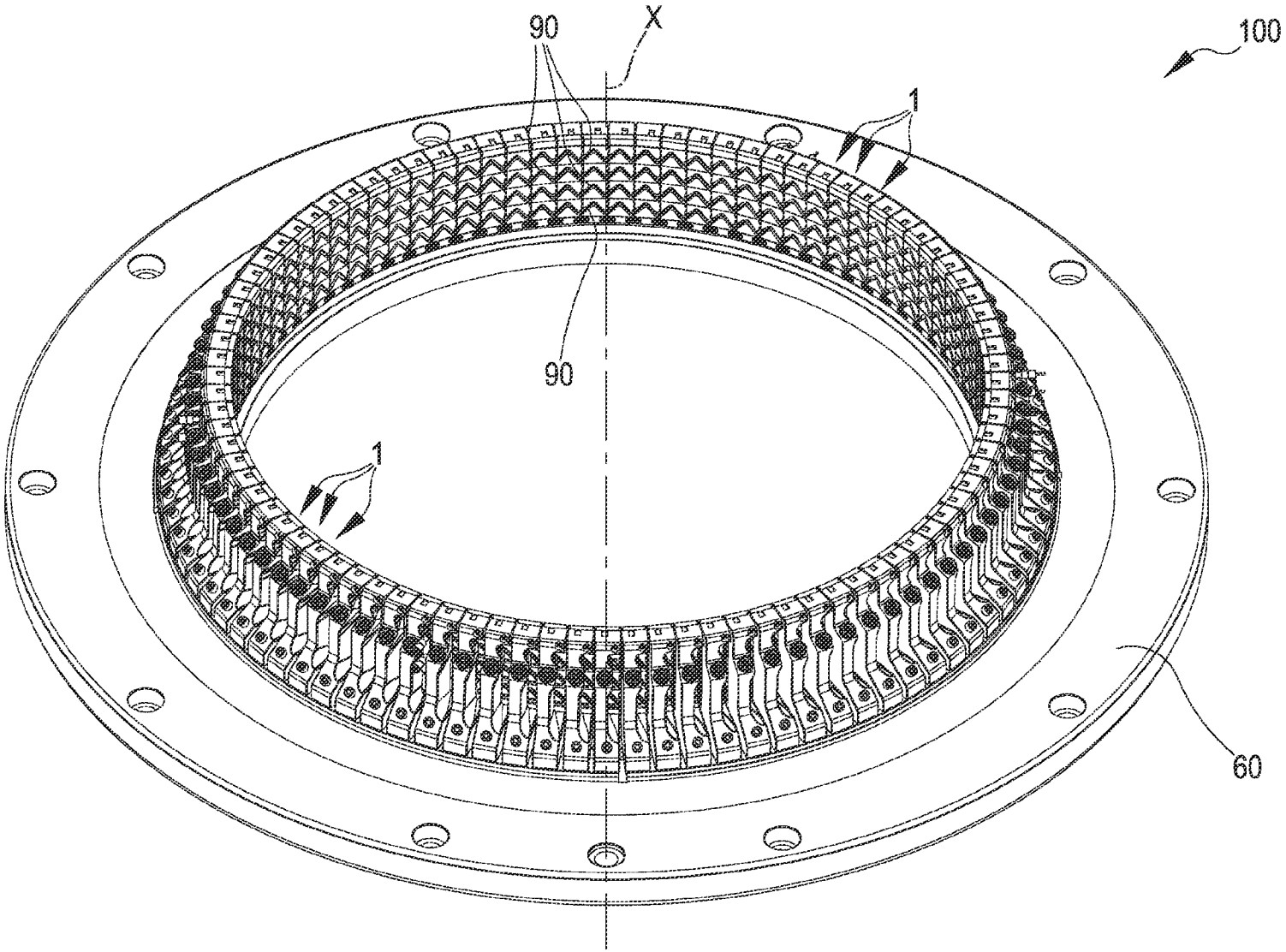
FIG. 18 shows a perspective view of a portion of a circular knitting machine according to the present invention, with some parts removed, provided with a plurality of devices for controlling the needles.
Figure 19:
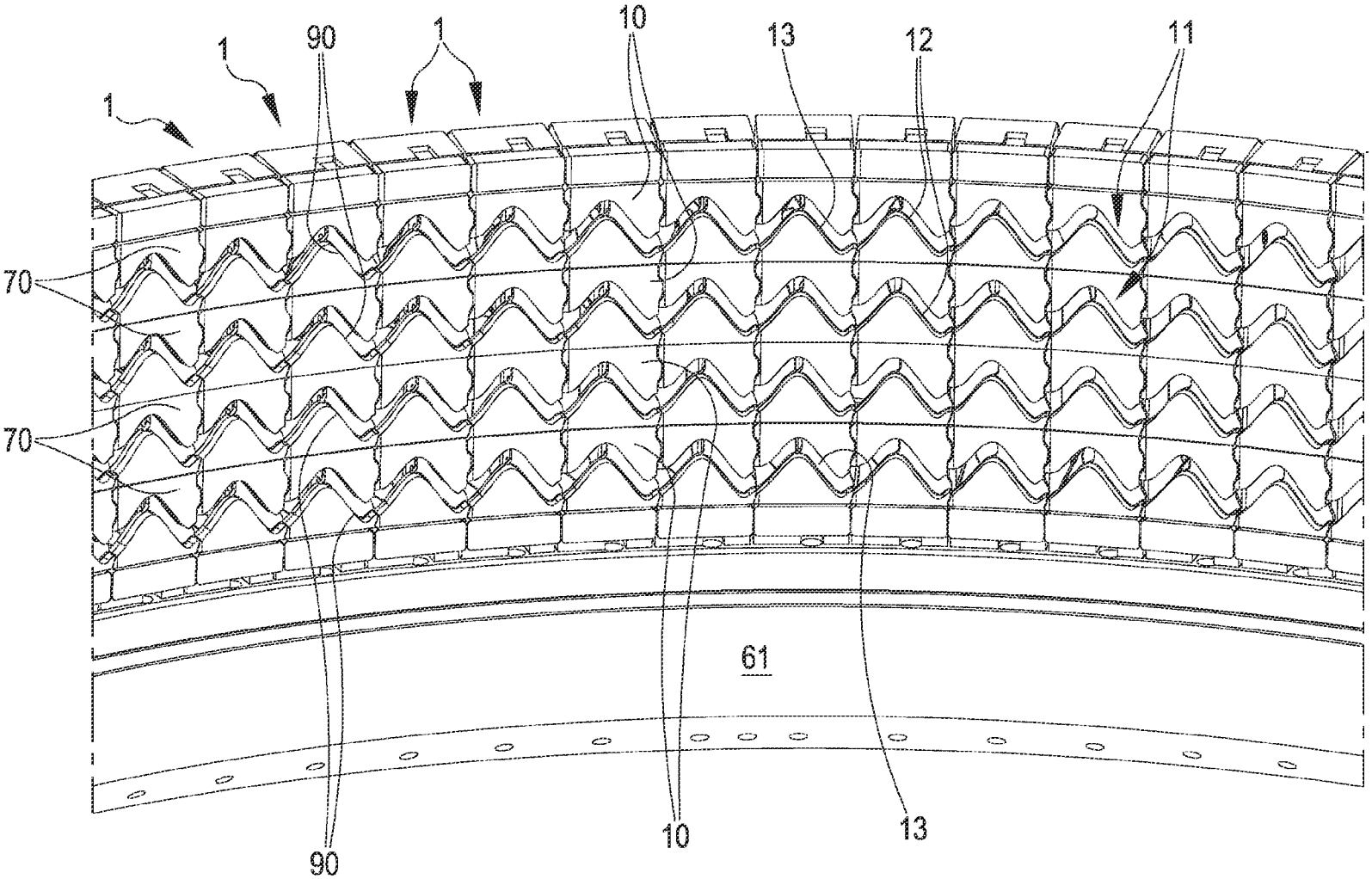
FIG. 19 shows an enlargement of a portion of FIG. 18.
Figure 20:
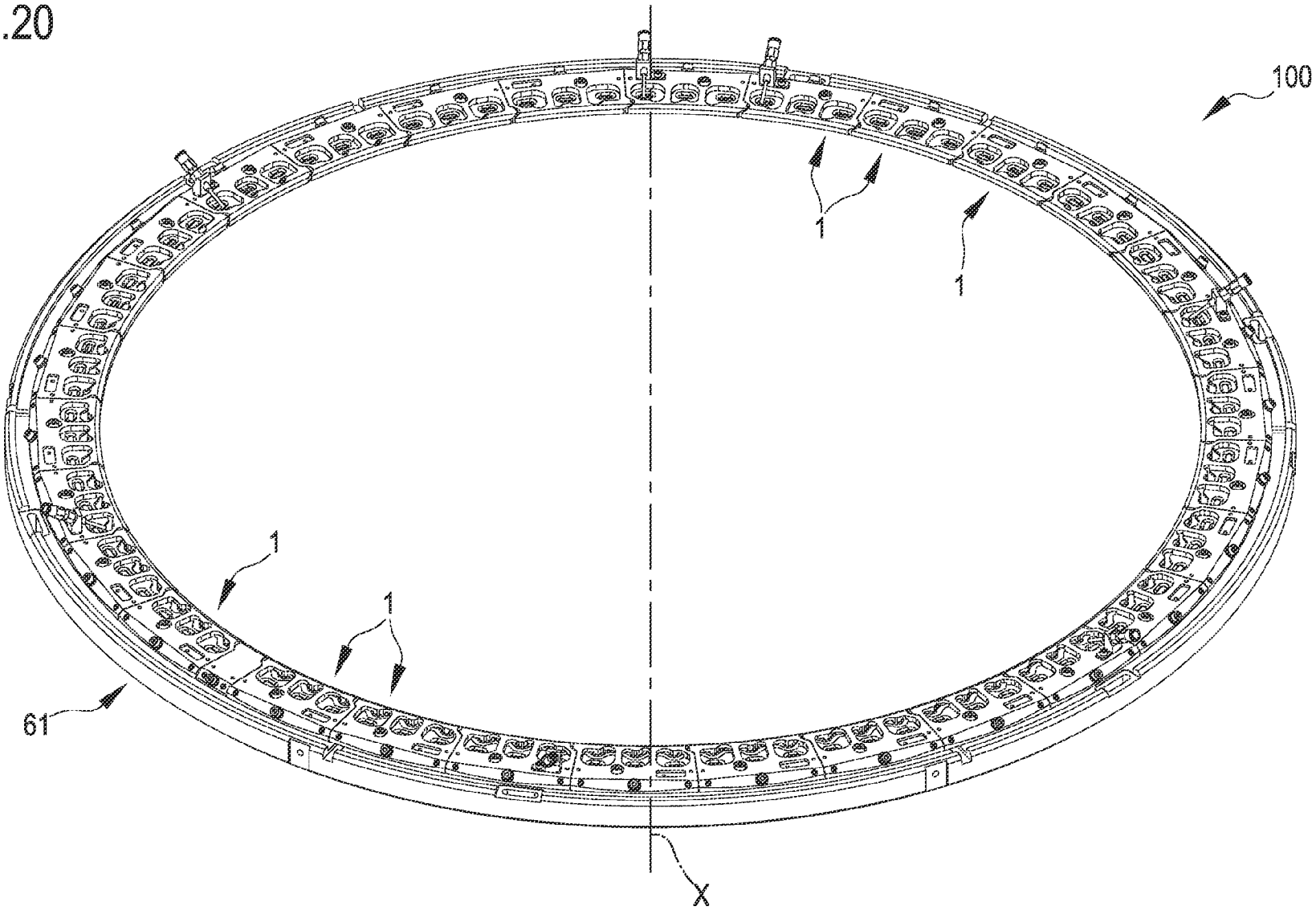
FIG. 20 shows a perspective view of a portion of a circular knitting machine according to the present invention, with some parts removed, provided with a plurality of devices for controlling the sinkers.

In FIGS. 1-5, 12-15 and 18-20 the component-holding unit is not shown, since it is of a known type and to make the figures clearer; the stitch formation components (movably associated with the component-holding unit) are directly shown in their interaction with the device 1 of the present invention.

The knitting head, as known, also comprises a series of devices and members which allow the control and movement of the stitch formation components.

The component-holding unit may have a variable diameter according to the knitting needs. The knitting machine further comprises a plurality of yarn feeding points, or yarn "feeds", in which the yarn is fed to the needles of the machine. Such feeds are positioned circumferentially around the component-holding unit and angularly spaced from each other.

From a textile technology point of view, the operation of the entire knitting machine is not described in detail, as it is known in the technical sector of the present invention.

The circular knitting machine also comprises a base, not shown as known per se, constituting the supporting structure of the machine, and the aforementioned knitting head 100 is mounted on the base.

The device 1 according to the present invention is therefore intended to be inserted in a circular knitting machine for knitting or hosiery, and in particular it is intended to be placed at a component-holding unit of the knitting machine.

The device 1 comprises at least a support body 6 provided with:

- a mounting portion 50 which allows the device to be mounted to the supporting structure of the circular knitting machine;
- a front side 10;
- a rear side 20.

The front side 10 faces the component-holding unit of the knitting machine and is provided with at least one cam 11 for controlling at least a part of the plurality of stitch formation components 2 (illustrated below). The cam 11 defines a guiding path 12 configured to interact with respective control butts 3 of each of the stitch formation components of said at least a part of said plurality of stitch formation components.

The rear side 20 is opposed to the front side 10 and is facing the outside of the knitting machine, away from the component-holding unit.

According to the preferred embodiments, shown by way of example in the figures, the device 1 comprises at least one through opening 30 between the front side 10 and the rear side 20, open on at least a portion of the guiding path 12.

Preferably, the through opening 30 defines an empty space 31 placing at least a portion of the guiding path 12 of the cam 11 in direct communication with the outside of the device 1 (and of the knitting machine), at least in an operative configuration of the device. In this way, the respective butts 3 of the stitch formation components 2 interacting with the cam 11 are facing and in direct communication with, said empty space 31.

It should be noted that the expression "empty space" identified a space between the front side 10 and the rear side 20 and free of the material with which the support body 6 of the device is made.

The expression "facing, and in direct communication with, said empty space" means that the butts 3 of the stitch formation components which interact with the cam 11 are accessible and reachable from the outside of the device, in particular from the rear side 20.

Preferably, each of the stitch formation components 2 is provided with a respective butt 3, configured to interact with said at least one cam 11. Preferably, each of the stitch formation components 2 has a single respective bead 3 which interacts with the cam 11.

Typically, the component-holding unit is configured to rotate around a central axis X of the knitting machine, to impart a roto-translational motion to the stitch formation components 2 so as to achieve the formation of the stitch.

Preferably, the guiding path 12 of the cam 11 is active, in succession, on the butts 3 of the stitch formation components 2 which interact, in sequence and due to the rotation of the component-holding unit, with the cam 11 of the device 1.

Preferably, the through opening 30 is open both on the front side 10 and on the rear side 20. Preferably, the through opening 30 is configured to allow the ejection, from the rear side 20, of fluff, filaments and dust accumulated or generated at the front side 10.

In particular, the through opening 30 allows the fluff to be ejected or removed from the device, towards the outside, said fluff mainly generated by friction and rubbing between the stitch formation components and the yarn fed, in the knitting machine, to produce yarn, and accumulating in particular at the butts of the stitch formation components, which slide within the guiding path of the cam.

Preferably, the body 6 of the device has a thickness, calculated as a dimension in a direction that goes from the front side 10 to the rear side 20.

Preferably, the device 1 comprises a first side face 40 and a second side face 41, transverse to—and structurally connecting—said front side 10 and said rear side 20.

Preferably, the first side face 40 and the second side face 41 are arranged on opposite sides with respect to the cam 11, and in particular with respect to the guiding path 12 of the cam.

Preferably, the first side face 40 and the second side face 41 develop at least partially from opposite sides with respect to the through opening 30.

Preferably, the body 6 of the device has a width, calculated as a dimension in a direction that goes from the first side face 40 to the second side face 41.

Preferably, the aforesaid width corresponds substantially to the development of the guiding path 12 of the cam 11, which interacts with the butts 3 of the stitch formation components 2.

Preferably, the body 6 of the device has a length (or height), calculated as a dimension in a direction concordant with, or parallel to, the development of the first side face 40 and the second side face 41.

Preferably, the through opening 30 has a given area (or extension or surface), on a section made on a parallel plane or concordant with the front side 10 and/or with the rear side 20, that is, on a section made on said thickness of the device body, comprised in said width and in said length.

Preferably, said given area of the through opening is substantially constant for the whole thickness of the body 6 of the device, that is, it is substantially constant from the front side 10 to the rear side 20.

Preferably, the through opening 30, and in particular the outlet on the guiding path 12, is configured in such a way that the butts 3 of the stitch formation components 2 interacting with the cam protrude, from the guiding path 12, inside of the empty space 31.

Preferably, the given area of the through opening 30 has such an extension and a shape as to simultaneously involve and be simultaneously in communication with a plurality of butts 3 of stitch formation components 2 interacting in sequence with the guiding path 12 of the cam 11, so that said plurality of butts is simultaneously in direct communication with the empty space 31 defined by the through opening 30.

Preferably, the plurality of butts 3 simultaneously in direct communication with the empty space comprises at least 2 or at least 5 or at least 10 or at least 20 or at least 50 butts.

Preferably, the portion of body 6 affected by the through opening 30 and by the empty space 31 is greater than the body portion of the device without a through opening (i.e. the body portion of the device in which the front side 10 and the rear side 20 are connected by solid material). In other words, preferably the through opening between the front side 10 and the rear side 20 is greater than the part of the body 6 in which the passage from the front side to the rear side is closed (due to the material itself that makes up the device body).

Preferably, said given area of the through opening 30 has such an extension and a shape as to simultaneously involve and be simultaneously in communication with, a number of butts 3 of stitch formation components 2 greater than the number of butts 3 interacting with the guiding path 12 of the cam 11 but not in direct communication with the empty space 31 defined by the through opening 30. In other words, preferably the number of butts "exposed" in the through opening 30, that is in communication with the empty space 31, is greater than the number of butts "covered" by the material of the device body 6, that is, not in communication with the through opening 30.

The expression front side 10 means the side (or surface) operatively facing the component-holding unit, that is, facing it and directed towards it, so that the stitch formation components 2 associated with the component-holding unit interact with the front side.

The expression rear side 20 means the side (or surface) geometrically opposite to the front side and not operationally related to the component-holding unit, i.e. not facing it and facing away from it, in such a way that the stitch formation components associated with the component-holding unit do not interact with the rear side.

Preferably, the through opening 30 has a greater extension at the rear side 20 and a smaller extension at the front side 10, where it leads onto at least a portion of the guiding path 12.

Preferably, the through opening 30 has an increasing extension as it passes through the thickness of the body 6 of the device from the front side 10 to the rear side 20.

Preferably, the mounting portion 50 is placed in the device not on said front side 10, preferably it is placed at the rear side 20.

Preferably, the mounting portion 50 is provided with suitable mounting means 51 of the body 6 of the device to the supporting structure of the knitting machine.

As shown in the embodiments of the figures, the front side 10 is free of undercuts or holes or concave surfaces facing the component-holding unit (obviously with the exception of the guiding path 12 of the cam 11). It should be noted that the absence, on the front side 10, of undercuts or holes or concave surfaces facing the component-holding unit may also be obtained in an embodiment of the device in which there is not, in the body of the device, the through opening 30 between front side 10 and rear side 20.

Preferably, the front side 10 has a smooth surface (except for the guiding path 12), facing the component-holding unit. Preferably, said surface of the front side 10 has a shape as a portion of cylindrical surface and/or is counter-shaped to the component-holding unit towards which it faces.

Preferably, the front side 10 is free of mounting members or means.

Within the scope of the present description and claims, the expression front side 10 identifies the portion of the front surface of the device which directly faces the component-holding unit, and which interacts with the stitch formation components. Therefore portions of the device which, although being on the part of the device on which the front side is defined, are not facing the component-holding unit, can be excluded from the front side. For example, below the surface of the front side where the guiding paths of the cams are defined, mounting members may be present, however the "front side" remains functionally free of undercuts or holes.

Preferably the front side 10 of the device 1 may comprise a plurality of cams 11 for controlling the plurality of stitch formation components 2, each cam defining a respective guiding path 12 configured for interacting with the butts 3 controlling one or more of said stitch formation components.

Preferably, the invention provides for the absence of mounting members or means on the part of the device facing the component-holding unit.

In a possible embodiment, not shown, the device may comprise at least one door configured to be mounted, preferably in a removable way, to the rear side of the device body, so as to selectively close, in certain operating conditions of the device, said through opening at the rear side. In one aspect, the door is mountable to the body or removable from the body respectively to prevent access, or to allow access, to said empty space defined by the through opening. When the door is not present, the device operates in said operative configuration in which at least a portion of said guiding path of said at least one cam is in direct communication with the outside of the device, through the empty space.

Figure 6:
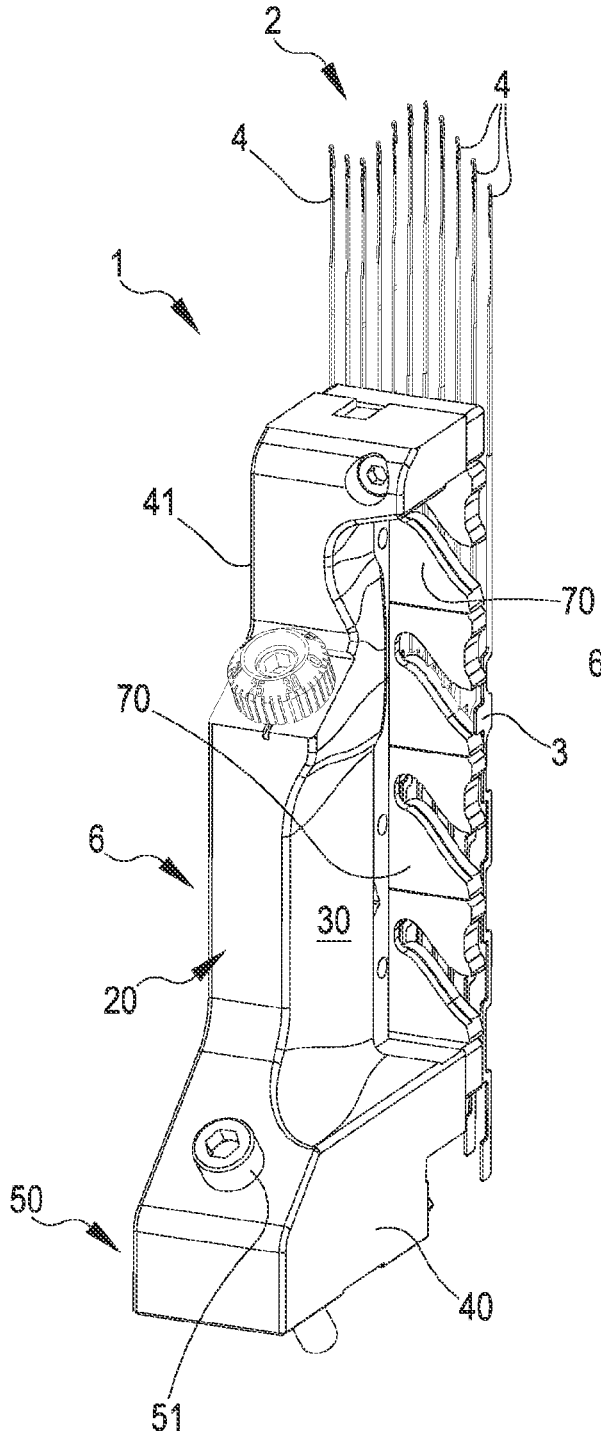
FIG. 6 shows a rear perspective view of a support and control device as in FIG. 4, and also shows a plurality of needles, of an exemplary type, while interacting with such a device in conditions of use in a circular knitting machine.
Figure 7:
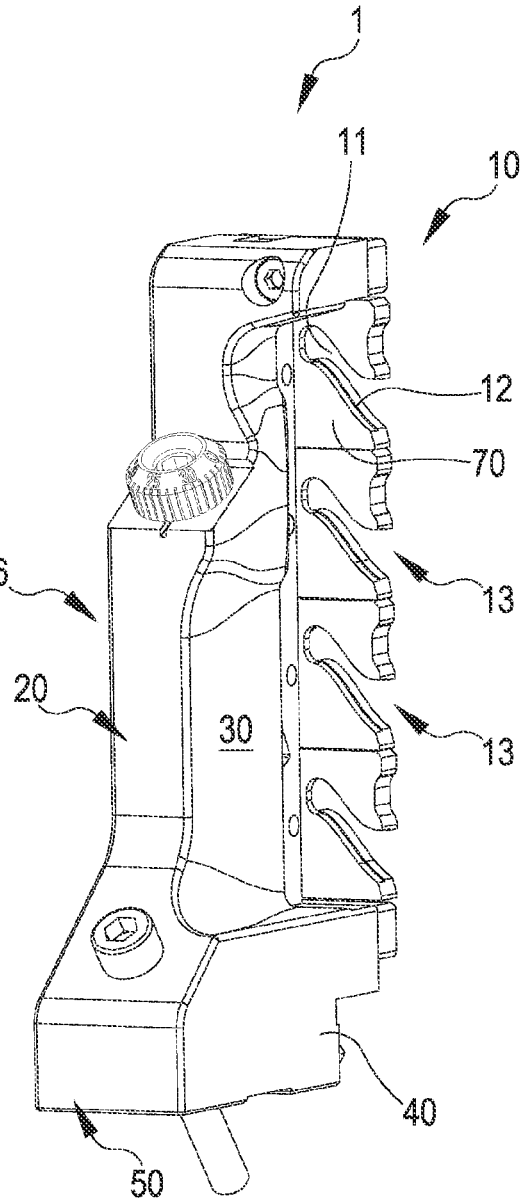
FIG. 7 shows a rear perspective view of only the support and control device of FIG. 6, without the aforementioned plurality of needles.
Figure 11:
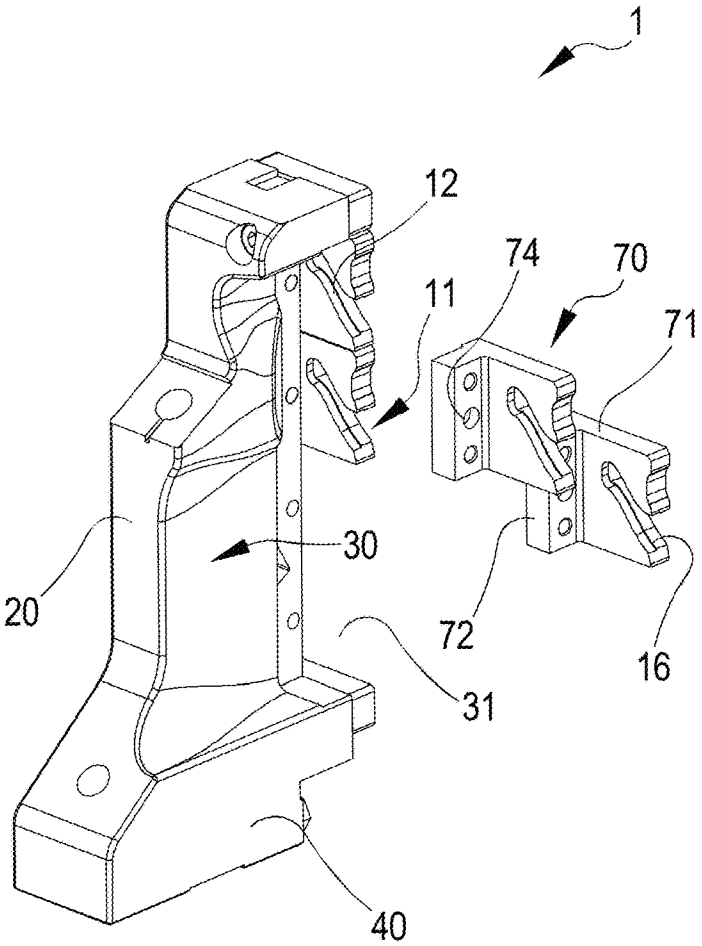
FIG. 11 shows a rear, partially exploded perspective view of the support and control device as shown in FIG. 10.
Figure 10:
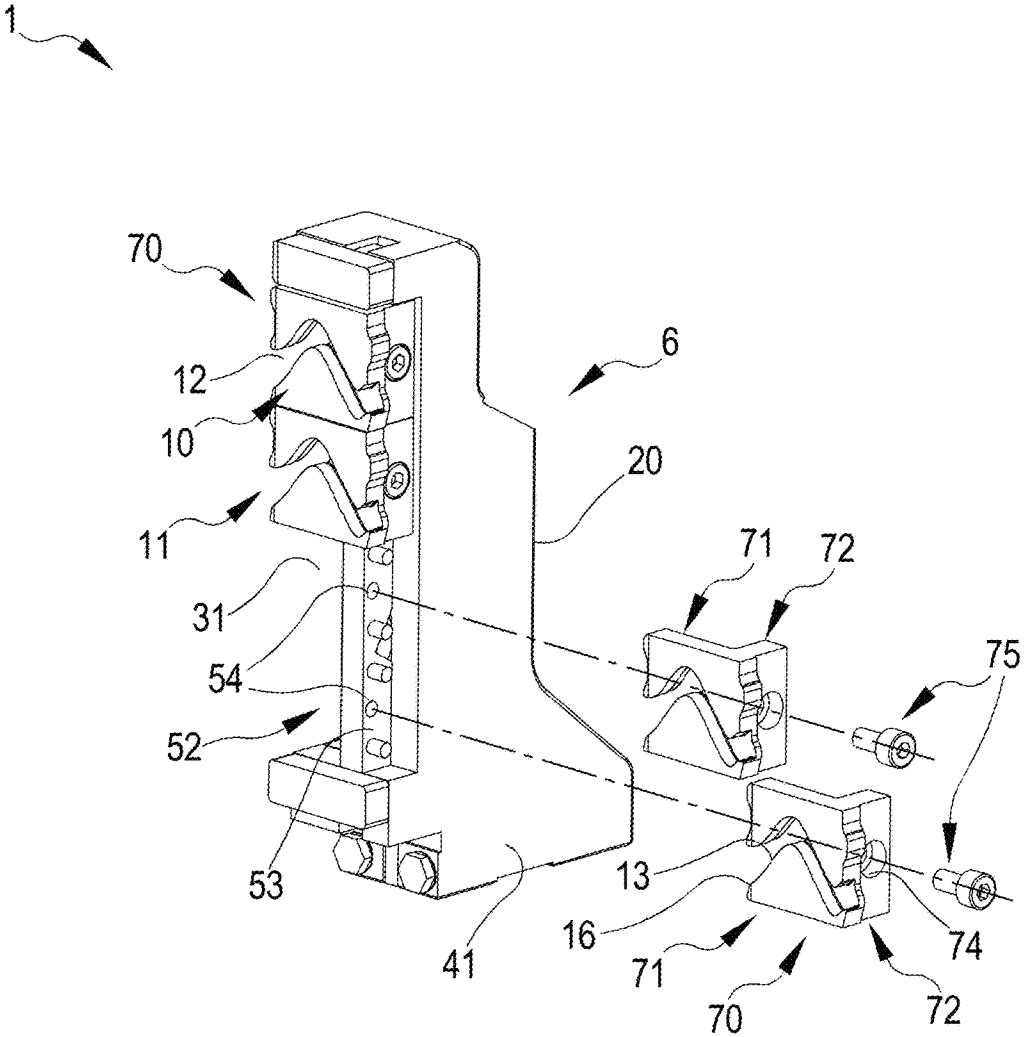
FIG. 10 shows a front, partially exploded perspective view of the support and control device of FIG. 7.

In a possible embodiment, illustrated by way of example in particular in FIGS. 1-11, the component-holding unit is a rotating needle-holding unit (i.e. a needle-holding cylinder or needle-holding plate), the plurality of stitch formation components 2 is a plurality of needles 4, and the supporting structure is a mounting ring 60 external to the needle-holding unit and integral with (or part of) the base of the knitting machine.

The mounting ring 60 is non-rotating, i.e. in operating conditions (when the knitting machine is producing stitches) it is fixed with respect to the needle-holding unit. Preferably, the mounting ring 60 can be adjustable in height, along a direction parallel to the central axis X, and/or angularly around the central axis X.

Preferably, in this embodiment, said at least one cam 11, defined on the front 10, is a stitch cam 13 for the control of the needles 4, configured to interact with the butts 3 of the needles 4 in transit due to the rotation of the needle-holding unit.

In more detail, the expression "stitch cam" means, in the textile machinery sector, an element intended to be placed at a feed to define the height assumed by each needle, in transit on the stitch cam, at such a feed. When the needle passes through a feed, it receives yarn to form a stitch: the formation of the stitch takes place, for each needle, on a stitch formation plane, placed at the vertical top of the needle-holding cylinder. The stitch cam determines a vertical movement of the needles along a direction parallel to the longitudinal development of the needle (and parallel to the axis of rotation of the cylinder). The vertical movement of each needle, managed by the stitch cam, is such as to vertically position the upper end (or head) of the needle at a desired height, so that the needle receives the yarn of the feed to which the stitch cam is associated, and then lower it to make a stitch. The stitch cam defines a guiding path, which intercepts the needles in rotation: this causes a vertical displacement of the needle according to a specific law of motion defined by the guiding path itself. Based on the vertical position of the stitch cam, the vertical dimension (in particular the minimum dimension) reached by the needle in the feed varies: consequently, the length (or width) of the stitch (or loop) made varies, since this width depends on the distance between the knitting surface and the lower point reached by the needle head. Typically, the stitch cams interact with a specific portion of the needle, consisting of the aforementioned butt. With the knitting machine in operation, that is, with the cylinder in rotation, all or a part of the needles cross, at each feed, the respective stitch cam of the feed, interacting with it.

Preferably, the body 6 of the device is configured to be positioned substantially vertically in the knitting machine, i.e. according to an orientation concordant or parallel with respect to the central axis X of the knitting machine, so that the front side 10 is externally and radially facing the needles 4 carried by the needle-holding unit and the butts 3 of the needles interact with the cam 13 and, passing along the guiding path 12, cross the through opening 30 in succession.

Preferably, the through opening 30 is laterally open on, i.e. it laterally ends on, the first side face 40 (as shown in FIGS. 1-11) or the second side face 41.

Preferably, the through opening 30 is laterally open on the side face, between the first side face 40 and the second side face 41, which is first reached by the butts 3 of the needles 4 according to the direction of rotation of the needle-holding unit around the central axis X.

In a possible embodiment, the through opening is laterally comprised (i.e. interposed) between the first side face and the second side face; in this case, the through opening does not lead and does not end laterally on the first side face or on the second side face.

Preferably, the distance between the front side 10 of the device and the stitch formation components (in particular the needles) is between 0.1 mm and 1 mm; by way of example, it is about 0.25 mm. In this way, the distance between the front side 10 (on which the stitch cam is defined) and the needles is sufficiently small to prevent the accumulation of fluff. In greater detail, the needles themselves—by effect of their rotation with respect to the devices—carry out a continuous "scraping" operation of the fluff from the first side of the devices, causing a push of the fluff towards the through openings, and from there the ejection thereof from the rear side.

In a possible embodiment, as shown in particular in FIGS. 6-11, the aforementioned cam 11 is defined on a cam body 70 removably mountable to the body 6 of the device, so that the guiding path 12 is defined on the front side 10. The cam body 70 is distinct and separate from the body 6.

Preferably, the cam body 70 comprises a front portion 71, on which the guiding path 12 is defined, and a fastening portion 72, placed laterally to the front portion 71 and provided with means for fastening the cam body 70 to a side face 40 or 41 of the device body 6.

Preferably, the cam body 70 has an overall L-shape, consisting of the front portion 71 and of the fastening portion 72, integral with each other and forming an angle between them, preferably 90°. The L-shape is observable along sections made on transverse planes of the cam body, on which the angle between the front portion and the fixing portion is defined.

Preferably, the front portion 71 and the fastening portion 72 of the cam body are in one piece (i.e. the cam body 70 is monobloc).

Preferably, the proportion, in the cam body 70, between the volume of the fastening portion 72 and the volume of the front portion 71 is at least ⅙ or at least ¼, or at least ⅓ or at least ½.

Preferably, said fastening means comprise at least one through hole 74 in the fastening portion 72 and at least one fastening screw 75, or equivalent element.

Preferably, the body 6 of the device is provided with members 52 for the removable fastening of the cam body 70, comprising a fastening wall 53 which develops rearwards to the front side 10 and provided with at least one fastening hole 54, said fastening wall being accessible at least from one of said side faces 40 or 41 of the body 6 of the device.

Preferably, the removable assembly of the cam body 70 to the body 6 of the device takes place by aligning the through hole 74 of the cam body with the fastening hole 54 of the device body, and inserting (laterally) and tightening the fastening screw 75, in such a way that the fastening portion 72 of the cam body 70 is on the first 40 or on the second side face 41.

Preferably, the fastening wall 53 is defined on a fastening element separate from the body 6 and mounted inside it, so as to be in a rear position with respect to the front side 10.

Said through hole 74 of the cam body and said fastening hole 54 of the device body are aligned along a mounting axis (illustrated in particular in FIG. 10), preferably horizontal. The fastening screw 75 is inserted and tightened from the side face where the cam body is assembled.

Preferably, said mounting axis is orthogonal to a vertical axis parallel to the central axis of rotation (and interposed between the front side and the rear side).

Preferably, said mounting axis lies on a vertical plane parallel to the central axis of rotation and tangent to a cylindrical surface centered on the central axis of rotation.

Preferably, the front side 10 is defined exclusively by a front surface of said at least one cam 11.

Preferably, as shown in particular in FIGS. 6-11, the front side 10 of the device may comprise a plurality of stitch cams 70 for controlling the needles 4, each cam defining a respective guiding path 12 configured to interact with the control butts 3 of a given sub-group of needles 4. Preferably, the plurality of stitch cams 70 is defined on a corresponding plurality of cam bodies 70 mounted on the front side of the device body. In the figures, which form an exemplary embodiment, each device 1 comprises four distinct cam bodies 70, each defining a respective cam 11 with respective guiding path 12.

Preferably, the stitch cams 11 of said plurality of stitch cams are arranged, on the front side 10, superimposed on each other according to a vertical succession, that is in sequence one above the other, so as to create a plurality of guiding paths 12 parallel to each other, each cam being configured to interact with the butts of a given sub-group of needles 4 provided with a butt 3 placed at a certain height such as to interact with the guiding path of the cam. For example, as can be observed in particular in FIGS. 6-11, each device comprises four distinct cams placed one on top of the other; this means that for each feed there are four distinct cam paths for the needle butts, and therefore it is possible to select different weaves. In this condition, considering that typically a needle has only one butt for the stitch cam, the plurality of needles is divided into four sub-groups (each comprising ¼ of the total needles), and each sub-group interacts with one of the four stitch cams of the device (at the yarn feed associated with the device).

Preferably, the length (or height) of the through opening 30 is such that the empty space 31 is in direct communication with all the guiding paths 12 of said plurality of cams 11.

Preferably, the through opening 30 is a unitary opening configured to be open frontally on at least a portion of all the guiding paths 12 of said plurality of cams 11.

In a further possible embodiment of the invention, illustrated by way of example in particular in FIGS. 1, 2 and 12-17, the component-holding unit is a rotating sinker-holding unit (i.e. a sinker ring or crown), the plurality of stitch formation components 2 is a plurality of knockover sinkers 5, and the supporting structure is a sinker cover 61 placed above or below the sinker-holding unit, that is, a supporting ring 61 integral with (or part of) the base of the knitting machine.

The sinker cover 61 is non-rotating, i.e. in operating conditions (when the knitting machine is producing stitches) it is fixed with respect to the base. Preferably, the sinker cover 61 can be adjustable in height, along a direction parallel to the central axis X, and/or angularly around the central axis X.

Preferably, in this embodiment, said at least one cam 11, defined on the front 10, is a sinker cam 14 for the control of the sinkers 5, configured to interact with the butts 3 of the sinkers 5 in transit due to the rotation of the sinker-holding unit.

Preferably, the body 6 of the device is configured to be positioned substantially horizontally in the knitting machine, i.e. according to an orthogonal orientation with respect to the central axis X of the knitting machine, so that the front side 10 is superiorly facing the sinkers 5 carried by the sinker-holding unit and the butts 3 of the sinkers 5 interact with the sinker cam 14 and, passing along the guiding path 12, cross the through opening 30 in succession.

In one embodiment, as shown in particular in FIGS. 12-17, the front side 10 of the device 1 may comprise a plurality of sinker cams 14 for controlling the sinkers 5, each cam 14 defining a respective guiding path 12 configured to interact with the control butts 3 of one or more sinkers 5.

The plurality of sinker cams of the device 1 may comprise, for example, two or three or four sinker cams in succession (in FIGS. 12-17 there are three by way of example), so that each guiding path 12 continues continuously in the guiding path 12 of the next sinker cam.

Preferably, the sinker cams 14 of said plurality of sinker cams are arranged, on the front side 10, side by side in succession, i.e. in sequence one after the other along the direction of rotation of the sinker-holding unit, so as to create a single continuous guiding path, each cam being configured to interact, in sequence, with the butts of the sinkers that reach the device.

Preferably, the device 1 may comprise a plurality of said through openings 30, each combined with a respective sinker cam 14 of said plurality of sinker cams.

The guiding path of the sinker cam 14 may be defined directly, for example by mechanical processing, on the front side 10 of the device body. Alternatively, as shown by way of example in the figures, the guiding path of the sinker cam may be defined on a separate sinker cam body, to be mounted on the body of the device.

In a possible embodiment, the body 6 of the device may comprise an additional through opening 35 between the front side 10 and the rear side 20, open on the front side in a position such as to intercept at least partially the rear ends 8 of the sinkers 5 interacting with the device, during the rotation of the sinker-holding unit, said additional through opening defining a respective additional empty space placing at least a portion of the front side 10 in direct communication with the outside of the knitting machine, at least in an operative configuration of the device, so that the rear ends 8 of the sinkers 5 interacting with the cam are facing, and in direct communication with, said additional empty space.

Preferably, the additional through opening 35 may be completely distinct from said through opening 30.

Alternatively, the additional through opening 35 is communicating, at least at the rear side 20 or by a portion of the thickness of the body 6 of the device, with the through opening 30.

Preferably, the device 1 comprises suction members 80 configured to generate a depression at the empty space 31 defined by the through opening 30, so as to cause suction in a direction from said front side 10 towards said rear side 20 and towards the outside of the device.

Preferably, the through opening is configured to allow the suction, from the rear side, or the blowing, at said empty space, of the residues of fluff ejected from the needles, during the rotation of the needle-holding unit, through the opening itself. In particular, the suction or blowing of the fluff may take place without the need to disassemble or remove the devices from the knitting machine. Suction is preferably carried out by means of a nozzle, suitably counter-shaped to the through opening, connected to suction means. Preferably, the nozzle is movable, i.e. it can be connected to the rear side of the device if necessary, to perform the suction, and can subsequently be removed and positioned at another device to be subjected to suction.

Preferably, the suction members 80 comprise at least one suction nozzle 81 applicable frontally, preferably removably, to the rear side 20 of the device body 6, said nozzle 81 being counter-shaped to the shape of the area of the through opening 30 at the rear side 20.

Preferably, the suction nozzle 81 has a tubular shape and extends between a front end 82, configured to be applied frontally to the rear side 20 of the device body, and a rear end 83, configured to be fluidly connected to suction means, for example to a vacuum cleaner, a compressor, a fan or a vacuum pump.

Preferably, the device comprises the aforementioned suction means.

In a possible embodiment of the present invention, the knitting machine may comprise the aforesaid suction members 80, and preferably it may comprise the aforesaid nozzle and said suction means, wherein the nozzle can be selectively positioned at the through opening 30 of a support and control device 1 and the suction means are activatable selectively to perform an aspiration towards the rear side and therefore inside the nozzle, to perform a cleaning of the support and control device. In this way it is possible, even with a single nozzle, by moving it between the various devices 1 of the knitting machine, to clean all the devices in succession.

Preferably, the support body 6 is integral or one-piece (with the exception of the cam bodies 70, if present).

Preferably, the device 1 constitutes a skirt or sector of a circular knitting machine, configured to support the control members associated with a given yarn feed, or yarn feeding point, in which the yarn is fed to the needles of the machine.

Preferably, the support body 6 is made of metal material, preferably steel or aluminum. In an alternative aspect, the support body may be of plastic material.

Preferably, the device body 6 is configured to exhibit a structural rigidity, despite the presence of the through opening, sufficient to avoid—in conditions of use—bending, in particular with respect to a plane parallel to the front side 10 or rear side 20, or vibratory phenomena.

Preferably, the stitch cam 13 is configured to interact with the butts of the needles 4 in transit due to the rotation of the needle-holding unit.

Preferably, the sinker cam 14 is configured to interact with the butts of the sinkers 5 in transit due to the rotation of the sinker-holding unit.

Preferably, the stitch cam 13 defines a guiding path for the needles 4 in transit (in particular for the needle butts) suitable for guiding the overall movement thereof parallel to the axis of rotation of the needle-holding unit.

Preferably, the sinker cam 14 defines a guiding path for the sinkers 5 in transit (in particular for the sinker butts) suitable for guiding their overall movement towards or away from the axis of rotation of the sinker-holding unit.

Preferably, each needle 4 or sinker 5 is a flat element, preferably metallic. Preferably, each needle or sinker comprises a main body lying substantially in a plane. Preferably, for each needle 4 or sinker 5 the main body comprises a flat bar, and the respective butt 3 is flat and extends transversely (orthogonally) from the flat bar.

In one aspect, the butt 3 is spaced from a terminal end of the main body.

A circular knitting machine for knitting or hosiery according to the present invention is described below (with reference to the knitting head 100 shown in the figures). Such a machine comprises at least:

- a supporting structure (or frame);
- at least one component-holding unit turnably mounted in said supporting structure so as to rotate around a central axis of rotation X;
- a plurality of stitch formation components 2 movably inserted into sliding compartments of the component-holding unit and moving so as to produce a knitted fabric.

The knitting machine further comprises a plurality of feeds or yarn feeding points on which the yarn is supplied to the machine needles, the feeds being positioned circumferentially around the component-holding unit and angularly spaced from each other.

The knitting machine further comprises at least one aforesaid support and control device 1, having the mounting portion 50 of the body 6 mounted to the aforesaid supporting structure, i.e. to the mounting ring 60 (see FIGS. 18 and 19) or to the sinker cover 61 (see FIG. 20), depending on whether the device 1 is intended to control needles 4 or sinkers 5. Preferably, as shown by way of example in the figures, and in particular in FIGS. 18-20, the knitting machine comprises a plurality of support and control devices 1, positioned circumferentially around the needle-holding unit, in which each of them is associated with a respective feed.

Preferably, the mounting portion 50 of the body 6 of each device 1, included in the knitting machine, is integral with the knitting structure, so that the device 1 is in a certain position with respect to a respective feed of said plurality of feeds.

Preferably, as illustrated above, the component-holding unit has the structure and function of a needle-holding cylinder or a needle-holding plate or a sinker-holding unit.

Preferably, the circular knitting machine comprises a plurality of support and control devices 1, positioned circumferentially around the component-holding unit.

Preferably, the support and control devices 1 are preferably spaced angularly or side by side angularly to each other, around the central axis of rotation X, preferably uniformly.

Preferably, the knitting machine comprises a plurality of substantially identical support and control devices (or two pluralities of identical devices, one comprising the devices for controlling the needles 4, the other comprising the devices for controlling the sinkers 5).

Preferably, the circular knitting machine is of the type with non-braked stitch formation components, i.e. each stitch formation component, movably inserted into the respective sliding compartment of the needle-holding unit, does not have any such braking means as to keep it autonomously in a given longitudinal position within the sliding compartment, but its longitudinal position in the compartment is determined and maintained by the respective butt engaged into the guiding path of the cams. In other words, a stitch formation component (needle or sinker) is defined as "braked" when it has geometric qualities (for example a permanent curvature) or means (for example foils or springs) which—once the component is inserted in the respective sliding compartment—cause "braking" thereof inside the compartment itself, that is, a stable condition even in the absence of external elements (such as a guiding cam) that keep it in position. The geometric qualities or the aforesaid means, in fact, generate a thrust of the components on the walls of the respective compartment, which avoid a movement (typically downwards) of the component in the compartment, and a change of position. The "unbraked" components, on the other hand, are the stitch formation components (needles 4 or sinkers 5) that do not have geometric features or means that keep them in position in the respective compartment, but constantly need to be guided and held in position, typically by a guiding cam (which engages the control butt thereof). In the absence of this external guide, the stitch formation component typically descends into the compartment or in any case moves to a different unguided position.

Preferably (see in particular FIGS. 18 and 19), the knitting machine according to the present invention has unbraked stitch formation components and comprises a plurality of support and control devices 1 placed circumferentially all around the component-holding unit and in continuous sequence one after the other, so that the plurality of guiding paths 12 of the devices 1 globally creates a continuous, complete circular track 90 having a closed annular shape developing around the central axis X.

Preferably, the end of each guiding path 12 of each supporting and control device 1 of the knitting machine leads to the beginning of the guiding path of the following support and control device, so that the guiding paths continue to form said continuous circular track 90. In other words, each cam 11 (i.e. each cam path 12) ends with a "funnel" outlet 16, and matches and continues in the next cam, so that the butts 3 can travel continuously, for successive rotations of the knitting machine, the continuous circular track 90, passing in succession all the support and control devices 1.

In essence, the knitting machine is preferably, but not exclusively, of the unbraked needle type with a continuous and complete track (circular cam path).

Preferably, the passage or transition area between each device and the following one does not introduce any discontinuity into the circular path.

Preferably, the plurality of support and control devices 1, placed side by side or joined one to the other, globally creates a cylindrical or annular unitary structure around or on said needle-holding unit.

Preferably, there is no free space (laterally) between each pair of adjacent support and control devices, with the exception of the through openings of each device.

Preferably, the through opening of a device according to the present invention is defined (or included) between the device itself and a side face of an adjacent device. This, in particular, when the through opening is open on one of the side faces of the device (as shown by way of example in the figures).

Preferably, the sinker-holding unit is a crown (or ring), not shown, arranged around the needle-holding cylinder, rotating integrally thereto around the central axis, and having a plurality of grooves facing the central axis, and the supporting structure is a fixed sinker cover located above the crown.

Preferably, each sinker 5 of said plurality of knockover sinkers is housed in one of the grooves and is movable, preferably radially, in the respective groove, each knockover sinker having a prong configured to cooperate with the needles and a butt 3 engaged with the guiding path defined by the sinker cams of the support and control devices, so that the guiding path moves the knockover sinker along the respective groove when the crown rotates with respect to the sinker cover and around the central axis.

The overall guiding path of the sinker cover, defined by the succession of support and control devices of the sinker cover, constitutes a circular track 90 having a closed annular conformation and developing around the central axis.

Preferably, at least one motor is operatively connected to the needle-holding cylinder and to the sinker-holding crown to rotate them around the central axis.

The invention thus conceived is subject to numerous modifications and variants, all falling within the scope of the inventive concept, and the components mentioned may be replaced by other technically equivalent elements.

The present invention is suitable for use on both new and existing machines, in the latter case replacing traditional structures for mounting components and devices for controlling needles and sinkers.

The invention achieves important advantages, both in structural and functional terms. First of all, the invention allows overcoming at least some of the drawbacks of the prior art.

In particular, the device of the present invention is structured in such a way as to prevent or severely limit the phenomena of accumulation of fluff, dust or dirt inside the knitting head. This is made possible by the presence of the aforementioned through opening and the aforementioned empty space, which constitute technical features not present in known solutions and in traditional devices, which allow easy ejection of fluff and dust as they are formed, preventing the accumulation of this material and the formation of agglomerations. In practice, the device according to the present invention, by virtue of the through opening, is always provided with a free passage—the empty space—between the front side and the rear side, through which the fluff can freely escape towards the outside of the machine. Furthermore, the device of the present invention avoids the accumulation of fluff, and allows it to escape, precisely in the typically most critical points, that is, at the paths of the cams in which the butts of the needles or sinkers slide. It should be noted that it is the needles and sinkers themselves that, by rotating, push the fluff out of the through openings of the devices 1. In essence, the needles and sinkers act as "scrapers" of the surface on the front of the devices, pushing the fluff towards the through openings and determining their ejection from the rear side.

The device of the present invention can operate in "self-cleaning" mode, that is, allow an autonomous ejection of the fluff to the outside of the knitting head, before accumulations can occur, possibly even without the need for external means or operator intervention.

In general, the device of the present invention allows limiting the cleaning operations of the knitting machine to a minimum.

The device of the present invention also allows limiting or cancelling the increase in friction between the needles or the sinkers (and in particular the respective butts) and the members of the knitting head, in particular the knitting cams or the sinker cams. In this way, the device allows considerably reducing the energy consumption necessary to move the needle-holding unit and the sinker-holding unit. The energy consumption in conditions of a new or perfectly clean knitting machine remains substantially the same even after operating for a long time and/or at high speeds, and after making a large quantity of yarn.

In general, the device of the present invention allows maintaining the performance of the knitting machine constant, eliminating the drops typically connected—in the known solutions—to the accumulation of fluff and dirt.

The device of the present invention also allows reducing downtime and minimizing complex and costly cleaning and maintenance operations.

In this way, it is possible to increase productivity and reduce the cost connected to the production of knitted fabric by the knitting machine.

The device of the present invention, being less subject to wear, overheating, exploitation of the motors, is characterized by a greater high reliability of operation and a lower predisposition to failures and malfunctions.

It is also possible, thanks to the device of the present invention, to increase the useful life of the components and to increase operating speed and productivity.

In addition, the device significantly improves access to the needle-holding cylinder even with the knitting machine mounted.

In addition to the above, the device of the present invention—and in particular the embodiment which provides a removable cam body which can be mounted to the body of the device and provided with a front portion and a fastening portion—allows overcoming the typical limits of the known solutions, in terms of the possibility of defining the cam guiding paths. In fact, the absence of mounting means on the front portion of the cam (the mounting means being on the fastening portion), and in particular the absence of holes on the front portion on which said guiding path is defined, allows exploiting the entire surface of the front portion to shape the guiding path, without the presence of mounting holes limiting the space available to trace the path. In this way, it is possible to modify the guiding path of the cam with greater freedom, exploiting the entire front surface of the cam body, and shape the up and down sections of the guiding path as desired. In the case of a support and control device provided with several cams superimposed on each other in vertical succession, i.e. in sequence one above the other, so as to create a plurality of parallel guiding paths, it is possible to reduce the so-called center distance between the various paths, i.e. the distance or vertical offset between each path and the underlying path. In fact, since there are no holes or fastening means, the front side of each cam can be reduced in height, since it must only accommodate the guiding path. The possibility of having several cams superimposed on each other in vertical succession, one above the other, to create a plurality of guiding paths parallel to each other, advantageously allows making different weaves in the same feed, which can be selectively engaged by the different needles; this increases the operational flexibility of the machine from a knitting point of view.

In general, the mounting of the cam body on the side face of the device body, through the side fastening portion of the cam body, is simpler and faster, both when the device is not yet mounted to the supporting structure, and when the device is already in position in the knitting machine.

Furthermore, the device of the present invention is characterized by a competitive cost and a simple and rational structure.

The invention claimed is:

1. A support and control device (1) for circular knitting machines, configured to be mounted in a circular knitting machine, wherein the circular knitting machine comprises at least one supporting structure, with at least one component-holding unit rotating around a central axis of rotation (X), and a plurality of stitch formation components (2) movably associated with the at least one component-holding unit, the device (1) comprising at least one support body (6) provided with:

a mounting portion (50) configured for allowing the device to be mounted to the at least one supporting structure of the circular knitting machine;

a front side (10) configured to face said at least one component-holding unit of the knitting machine and provided with at least one cam (11) for controlling at least a part of said plurality of stitch formation components (2), said at least one cam (11) defining a guiding path (12) configured for interacting with respective butts (3) of the stitch formation components (2) for controlling each of the stitch formation components (2) of said at least a part of said plurality of stitch formation components;

a rear side (20), opposed to said front side (10) and configured to face an outside of the knitting machine, away from said at least one component-holding unit;

wherein the device (1) comprises at least one through opening (30) between said front side (10) and said rear side (20), open on at least one portion of said guiding path (12), said at least one through opening (30) defining an empty space (31) placing at least a portion of said guiding path (12) of said at least one cam (11) in direct communication with an outside of the device, at least in an operating configuration of the device, so that the respective butts (3) of the stitch formation components (2), interacting with the at least one cam (11), face and are in direct communication with said empty space (31), wherein the at least one support body (6) of the device has a thickness, calculated as a dimension in a direction from the front side (10) to the rear side (20), and wherein the device comprises a first side face (40) and a second side face (41), which are transversal to and structurally connect said front side (10) and said rear side (20), wherein said at least one cam (11) is defined on a cam body (70) removably mountable to the at least one support body (6) of the device, so that the guiding path (12) is defined on said front side (10), and wherein said cam body (70) comprises a front portion (71) on which said guiding path (12) is defined, and a fastening portion (72) placed laterally to said front portion (71) and provided with fastening members, the fastening members comprising at least one hole (74) in the fastening portion (72) and at least one fastening screw (75) for fastening the cam body (70) to one of the first side face (40) and the second side face (41) of the at least one support body (6) of the device, wherein the at least one support body (6) of the device is provided with members (52) for a removable fastening of the cam body (70) to the at least one support body (6), comprising at least one fastening hole (54), wherein the at least one hole (74) of the cam body (70) and the at least one fastening hole (54) of the at least one support body (6) are aligned along a mounting axis, said mounting axis being orthogonal to a vertical axis, the vertical axis being parallel to the central axis of rotation (X).

2. The device (1) according to claim 1, wherein said empty space (31) is a space between said front side (10) and said rear side (20), free from a material which the at least one support body (6) of the device is made of, and/or wherein said guiding path (12) of the at least one cam (11) acts in sequence (3) upon the butts of the stitch formation components (2) interacting, in sequence and by means of the rotation of the component holding unit, with said at least one cam (11) of the device, and/or wherein said at least one through opening (30) is open both on the front side (10) and on the rear side (20), and/or wherein said at least one through opening (30) is configured for allowing lint, filaments and powder heaped up or generated on said front side (10) to be pushed out from said rear side (20).

3. The device (1) according to claim 1, wherein said mounting portion (50) is not placed on the device (1) on said front side (10), and/or wherein said front side (10) is without undercuts or holes or hollow surfaces configured to face said at least one component-holding unit, except said at least one through opening (30).

4. The device (1) according to claim 1, wherein the first side face (40) and the second side face (41) are arranged on opposite sides with respect to said at least one cam (11)

and/or wherein the first side face (40) and the second side face (41) develop at least partially on opposite sides with respect to said at least one through opening (30).

5. The device (1) according to claim 4, wherein the at least one support body (6) of the device has a length, calculated as a dimension in a concordant or parallel direction to an extension of said first side face and second side face, and wherein said at least one through opening (30) has a given area, on a section taken on a parallel or concordant plane to said front side (10) and/or said rear side (20), i.e. on a section taken on said thickness of the at least one support body (6) of the device, comprised in said length, and/or wherein said at least one through opening (30) is configured so that the butts (3) of the stitch formation components (2) interacting with the at least one cam (11) protrude from said guiding path (12) into said empty space (31).

6. The device (1) according to claim 5, wherein said given area of the at least one through opening (30) has such an extension and a shape as to simultaneously involve and be simultaneously in communication with a plurality of butts (3) of stitch formation components (2) interacting in sequence with the guiding path (12) of the at least one cam (11), so that said plurality of butts (3) are simultaneously in direct communication with said empty space (31) defined by the at least one through opening (30), and wherein said plurality of butts (3) being simultaneously in direct communication with said empty space (31) comprises at least 5 or at least 10 or at least 20 or at least 50 butts, and/or wherein the front side (10) of the device comprises a plurality of cams (11) for controlling said plurality of stitch formation components (2), each of the plurality of cams (11) defining a respective guiding path (12) configured for interacting with the butts (3) controlling one or more of said stitch formation components (2).

7. The device (1) according to claim 5, wherein a portion of the at least one support body (6) of the device involved by said at least one through opening (30) and by that empty space (31) is larger than a portion of the at least one support body (6) of the device without any through opening, and/or wherein said given area of the at least one through opening (30) has such an extension and a shape as to simultaneously involve and be simultaneously in communication with a number of butts (3) of stitch formation components (2) that is larger than the number of butts (3) interacting with the guiding path (12) of the at least one cam (11) but not in direct communication with the empty space (31) defined by the at least one through opening (30).

8. The device (1) according to claim 1, wherein said front side (10) is a side or a surface that operatively addresses the at least one component-holding unit, i.e. configured to face it and directed towards it, so that the stitch formation components (2) associated with the at least one component-holding unit interact with said front side, and wherein the rear side (20) is a side or a surface that is geometrically opposed to the front side (10) and not operatively connected to the at least one component-holding unit, i.e. configured not to face the at least one component-holding unit and directed away from the at least one component-holding unit, so that the stitch formation components (2) associated with the at least one component-holding unit do not interact with said rear side, and/or wherein said at least one through opening (30) has a larger extension on said rear side (20) and a smaller extension on said front side (10), where it ends on at least a portion of said guiding path (12), and/or wherein said at least one through opening (30) has a growing extension as it gets through the thickness of the at least one support body (6) of the device from said front side (10) to said rear side (20).

9. The device (1) according to claim 1, wherein said at least one component-holding unit is a rotating needle-holding unit, said plurality of stitch formation components (2) is a plurality of needles (4), and said at least one supporting structure comprises a mounting ring (60) outside the needle-holding unit, and wherein said at least one cam (11), defined on said front side (10), is a stitch cam (13) for controlling the needles (4), configured for interacting with butts (3) of the needles (4) moving as a result of the rotation of the needle-holding unit, and/or wherein said at least one support body (6) of the device is configured for being placed basically vertically in the knitting machine, i.e. according to a concordant or parallel orientation to the central axis (X) of the knitting machine, so that said front side (10) faces outside and radially the needles held by the needle-holding unit and the butts (3) of the needles (4) interact with said stitch cam (13) and, while getting on said guiding path (12), get through said at least one through opening (30) in sequence, and/or wherein said at least one through opening (30) is laterally open on, i.e. it laterally ends on, said first side face (40) or said second side face (41).

10. The device (1) according to claim 1, wherein said at least one component-holding unit is a rotating sinker-holding unit, said plurality of stitch formation components (2) are a plurality of knockover sinkers (5), and said supporting structure is a sinker cover (61) placed on above the sinker-holding unit, and wherein said at least one cam (11), defined on said front side, is a sinker cam (14) for controlling the sinkers (5), configured for interacting with butts (3) of the sinkers (5) moving as a result of a rotation of the sinker-holding unit, and/or wherein said at least one support body (6) of the device is configured for being placed basically horizontally in the knitting machine, i.e. according to an orthogonal orientation to the central axis (X) of the knitting machine, so that said front side (10) faces from above the sinkers (5) held by the sinker-holding unit and the butts (3) of the sinkers interact with said sinker cam (14) and, while getting on said guiding path (12), get through said at least one through opening (30) in sequence.

11. The device (1) according to claim 1, wherein the distance between the front side (10) and the stitch formation components is between 0.1 and 1 mm, and/or wherein said at least one through opening (30) is configured for allowing residues of lint pushed out from the stitch formation components to be sucked from the rear side (20) or blown in said empty space (31), during the rotation of the at least one component-holding unit, through the at least one through opening itself, without disassembling or removing the device.

12. A circular knitting machine for knitted or hosiery items, comprising:

a supporting structure;

at least one component-holding unit turnably mounted in said supporting structure so as to rotate around a central axis of rotation (X);

a plurality of stitch formation components (2) movably inserted into sliding compartments of the at least one component-holding unit and moving so as to produce a knitted fabric;

the knitting machine comprising a plurality of feeds or yarn feeding points on which a yarn is supplied to the knitting needles, the feeds being positioned circumferentially around the at least one component-holding unit and angularly spaced from each other, the knitting machine further comprising at least one support and control device (1) according to claim 1, wherein the mounting portion (50) of the at least one support body (6) is integral with said supporting structure, so that the at least one support and control device (1) takes a given position with respect to a respective feed of said plurality of feeds or yarn feeding points.

13. The knitting machine according to claim 12, wherein the circular knitting machine is of a type with non-braked stitch formation components, i.e. a longitudinal position of each of the plurality of stitch formation components (2), into the respective sliding compartments of a component-holding unit, is determined and maintained by the respective butt (3) engaged into the guiding path (12) of the at least one cam (11), and wherein the knitting machine comprises a plurality of support and control devices (1) placed circumferentially all around said at least one component-holding unit and in continuous sequence one after the other, so that a plurality of guiding paths (12) of the plurality of support and control devices globally create a continuous, complete circular track (90) having a closed annular shape developing around the central axis (X).

14. The knitting machine according to claim 12, the at least one supporting and control device being multiple support and control devices, wherein an end of each guiding path (12) of each of the supporting and control devices (1) leads to a beginning of a guiding path (12) of a following support and control device, so that the guiding paths (12) continue to form said continuous circular track (90), and/or wherein a passage or a transition area between each of the support and control devices and a following support and control device does not introduce any discontinuity into the circular track, and/or wherein the plurality of support and control devices (1), placed side by side or joined one to the other, globally creates a cylindrical or annular unitary structure around or on a needle-holding unit.

15. The device (1) according to claim 1, wherein said mounting portion (50) is placed on said rear side (20).

* * * * *